US007775004B2

(12) United States Patent
Allen

(10) Patent No.: US 7,775,004 B2
(45) Date of Patent: Aug. 17, 2010

(54) SILL FLASHING AND ASSOCIATED METHOD

(76) Inventor: L. Ross Allen, 1201 Jericho La., Charlotte, NC (US) 28270

( * ) Notice: Subject to any disclaimer, the term of this patent is extended or adjusted under 35 U.S.C. 154(b) by 306 days.

(21) Appl. No.: 11/688,438

(22) Filed: Mar. 20, 2007

(65) Prior Publication Data

US 2008/0229676 A1 Sep. 25, 2008

(51) Int. Cl.

| | |
|---|---|
| ***E04D 13/00*** | (2006.01) |
| ***E04D 1/36*** | (2006.01) |
| ***E06B 1/04*** | (2006.01) |
| ***E06B 3/00*** | (2006.01) |
| ***E06B 7/14*** | (2006.01) |
| ***E04B 1/70*** | (2006.01) |

(52) U.S. Cl. ..... 52/209; 52/212; 52/302.3; 52/302.6; 52/208; 52/97; 52/58

(58) Field of Classification Search ..... 52/58–62, 52/208, 209, 745.15, 97, 212, 302.3, 302.6
See application file for complete search history.

(56) References Cited

U.S. PATENT DOCUMENTS

| | | | | |
|---|---|---|---|---|
| 1,677,130 | A | 7/1928 | Cherry | |
| 1,935,116 | A | 11/1933 | Friedberg | |
| 1,976,166 | A | 10/1934 | Friedberg | |
| 2,154,734 | A | 4/1939 | Doing | |
| 2,296,499 | A | 9/1942 | Beutow | |
| 2,648,107 | A | 8/1953 | Bates, Jr. | |
| 2,697,932 | A * | 12/1954 | Goodwin | 52/97 |
| 3,124,427 | A | 3/1964 | Chomes | |
| 3,239,977 | A | 3/1966 | Shore | |
| 4,492,062 | A | 1/1985 | Levenez | |
| 4,555,882 | A | 12/1985 | Moffitt et al. | |
| 4,594,818 | A | 6/1986 | Prestidge | |
| 4,745,716 | A | 5/1988 | Kuypers | |
| 4,750,301 | A | 6/1988 | Croxford | |
| 4,951,431 | A | 8/1990 | Sweers | |
| 4,966,819 | A | 10/1990 | Schatz et al. | |
| 5,072,552 | A | 12/1991 | Sauder | |
| 5,115,603 | A | 5/1992 | Blair | |

(Continued)

OTHER PUBLICATIONS

Lincoln Wood Products, Inc., *Flanged Window Installation*; instructions; Mar. 2003; two pages.

(Continued)

*Primary Examiner*—Brian E Glessner
*Assistant Examiner*—Omar Hijaz
(74) *Attorney, Agent, or Firm*—Alston & Bird LLP

(57) ABSTRACT

A sill flashing and method for installing a window or other portal in a wall opening are provided. The flashing includes a sill portion, at least one jamb portion at an angle relative to the sill portion, and a front face plate. The flashing is configured to be disposed in the opening with the sill portion disposed against a sill of the opening, an outer surface of the jamb portion disposed against one of the jambs of the opening, and a front face plate at an outer surface of the wall. The sill portion defines a plurality of support portions and a rear dam which can support the portal in the opening. The sill portion also includes one or more integral housing, configured to overlap an adjacent support portion when the flashing is cut and disposed multiple parts defining an interface therebetween.

19 Claims, 19 Drawing Sheets

U.S. PATENT DOCUMENTS

| | | | | |
|---|---|---|---|---|
| 5,349,792 | A | 9/1994 | Bayes | |
| 5,377,464 | A | 1/1995 | Mott et al. | |
| 5,414,964 | A | 5/1995 | Bodycomb | |
| 5,605,019 | A | 2/1997 | Maziekien et al. | |
| 5,822,934 | A | 10/1998 | O'Donnell | |
| 5,894,697 | A | 4/1999 | Hunter | |
| 5,921,038 | A | 7/1999 | Burroughs et al. | |
| 5,946,870 | A | 9/1999 | Schatz et al. | |
| 5,956,909 | A | 9/1999 | Chou | |
| 6,047,502 | A | 4/2000 | Kimmitt et al. | |
| 6,122,874 | A | 9/2000 | Smerilli | |
| 6,293,064 | B1 | 9/2001 | Larson | |
| 6,298,621 | B1 | 10/2001 | Lee | |
| 6,305,130 | B1 | 10/2001 | Ackerman, Jr. | |
| 6,385,925 | B1 | 5/2002 | Wark | |
| 6,401,401 | B1 | 6/2002 | Williams | |
| 6,401,402 | B1 | 6/2002 | Williams | |
| 6,457,279 | B1 | 10/2002 | Jacobsen et al. | |
| 6,526,709 | B1 | 3/2003 | Jacobsen | |
| 6,539,675 | B1 | 4/2003 | Gile | |
| 6,681,530 | B1 | 1/2004 | Givens | |
| 6,715,237 | B2 | 4/2004 | Batt | |
| 6,725,610 | B2 | 4/2004 | Murphy et al. | |
| 6,792,725 | B1 | 9/2004 | Rutherford | |
| 7,367,164 | B2 * | 5/2008 | Burton et al. | 52/209 |
| 2005/0011140 | A1 * | 1/2005 | Ackerman et al. | 52/58 |
| 2005/0055912 | A1 * | 3/2005 | Teodorovich | 52/261 |
| 2005/0166471 | A1 * | 8/2005 | Allen | 52/58 |
| 2005/0204657 | A1 | 9/2005 | Ellingson | |
| 2005/0210768 | A1 * | 9/2005 | Lawson et al. | 52/97 |
| 2005/0262782 | A1 | 12/2005 | Harrison et al. | |
| 2006/0260213 | A1 * | 11/2006 | Williams | 52/60 |

OTHER PUBLICATIONS

Anderson Corporation; Anderson® Windowalls®; *Perma-Shield® Double-Hung Windows*; PP/Product Presentation; p. 22 and 23.

* cited by examiner

SILL FLASHING AND ASSOCIATED METHOD

FIELD OF THE INVENTION

This invention relates to the installation of windows, doors, or other building members and, more particularly, relates to a sill flashing for directing water out of an opening in a wall and preventing leakage of the water to the sill of the opening.

BACKGROUND OF THE INVENTION

During a typical installation of a window in a building, a rough opening is first prepared in a wall of the building for receiving the window. The rough opening is defined by two jambs that extend vertically from a head at the top of the rough opening to a sill at the bottom of the opening. In some cases, a weather resistant barrier material, such as a thin sheet of waterproof paper or plastic is disposed over the outer surface of the wall, and the barrier material is cut at the rough opening and folded into the opening. The barrier material forms a moisture barrier extending over the outer surface, but, due to the cuts, the barrier material does not normally provide a waterproof barrier on the inner surfaces of the rough opening. In particular, the barrier typically defines openings at the intersection of the jambs and the sill where the barrier material is cut to allow folding thereof. In some cases, a rigid sill flashing can be installed across the sill. The sill flashing extends outward from the sill onto a portion of the outer surface of the wall and upward from the sill onto a portion of each jamb. Thus, the sill flashing, which is formed of a flexible sheet of material such as metal, is cut and bent to correspond to the sill, jambs, and outer wall surface. Typically, two cuts are made in the sill flashing, each cut extending from a respective corner of the sill and the jambs through the portion of the sill flashing that is disposed on the outer surface of the wall. Thereafter, the flashing is welded to seal the cuts in the flashing at the corners of the opening.

The window can be structured to prevent rain or other water contacting the outer surface of the window from flowing to the sill of the rough opening. However, in some cases, the window can leak water to the sill. Water flowing to the sill of the rough opening can sometimes penetrate both the barrier material and the flashing, e.g., through the cuts that are made in the barrier material and the flashing during installation. Thus, the water can flow into the wall, i.e., between the inner and outer surfaces of the wall, causing damage to the wall.

U.S. Pat. No. 7,059,087, invented by the present inventor, describes a flashing that can be disposed at the corner of an opening in a wall, e.g., under a window or other portal, to prevent the entry of water at the corner. U.S. Patent Application Publication No. 2005/0166471, also invented by the present inventor, describes methods for using such flashings and further describes the use of such flashings with a laminar moisture barrier sheet disposed on the outer surface of the wall. In some cases, first and second flashings can be disposed, respectively, at the two lower corners of an opening in a wall, and a third flashing can be disposed therebetween. The interfaces of the flashings can be covered with tape to prevent water from passing through the interfaces to the sill of the opening. While these flashings and methods provide important improvements, further improvements are desirable.

Some conventional flashing members that are provided at the sill of an opening include a lower portion that is disposed beneath the window and a back dam that extends vertically upward from lower portion at the inside edge of the lower portion. U.S. Pat. No. 1,677,130 describes a sill flashing that includes an intermediate flashing 19 and an upstanding flange 31 on the rear edge thereof. The upstanding flange 31 extends upward above the top of the intermediate flashing 19 and in contact with the side of the sill 14 of the window. While such back dams generally decrease the likelihood of water passing under the sill and into the building, the back dam can increase the complexity of the installation of the window.

For example, during a typical window installation, the window is placed in the opening of the wall (from the outside) and then shims are selectively inserted (from the inside) under the window to adjust the window to a desired placement, e.g., to raise the window slightly or to adjust the sill of the window to a horizontal configuration. However, as shown in FIG. 1 of U.S. Pat. No. 1,677,130, the upstanding flange 31 prevents the insertion of shims between the flashing and the sill 14 from the rear, i.e., the interior of the building. Further, since the flashing is disposed in the opening and nailed in place before the window is positioned, shims cannot be inserted below the flashing without removing the window and flashing or deforming the flashing. Thus, the back dam prevents or complicates the use of shims for adjusting the window after the window is placed in the opening. In some cases, the window must be removed in order to place the shims on the flashing, or the installer may simply omit the shims, such that the window may not be properly horizontally positioned.

In addition, a conventional method for installing a window includes installing drywall on the interior surface of the wall after the flashing (and, typically, the window) is installed. The drywall is installed in large sheets, and typically the sheets are not precut with holes for the window. That is, an installer typically installs the drywall to partially or completely cover the window opening, and only then cuts the drywall to remove the portion at the opening of the window. In one typical method, the window is installed in a wall opening that has rough dimensions (in width and height) that are at least one-half inch greater than the outer dimensions of the window. This relative difference in size between the window and the opening provides space for the insertion of shims around the window and typically results in a small space or gap around the window. An installer can use this gap as a guide for cutting the drywall. For example, with the window installed and the drywall installed to at least partially cover the opening, the installer can use a router to cut the drywall around the periphery of the window, using the space between the periphery of the window and the opening as a guide for the bit of the router. Unfortunately, when the router is moved against a flashing, the router may cut through the flashing. In particular, if the sill flashing is disposed tightly against the sill and jambs of the opening, the installer will typically move the router bit downward along one of the jambs of the opening toward the sill, between the window and the flashing. As the router contacts the back dam of the flashing, the back dam can be cut or otherwise damaged, thereby potentially reducing the effectiveness of the back dam for preventing water intrusion.

Further, a conventional back dam extends upward beyond the bottom of the window and is disposed against the inside surface of the window, such that the height of a conventional back dam is restricted by the configuration of the window. For example, the back dam typically cannot have a height that is greater than the height of the bottom frame or sill of the window, as a higher back dam would extend upward beyond the bottom frame resulting in an aesthetically undesirable appearance. Further still, the location of the back dam against the inside surface of the window adds to the thickness of the window frame at the bottom of the window such that the inside surface of the window frame at the top and sides of the window is not coplanar with the inside surface of the back dam at the bottom of the window. Thus, if a planar member, such as an interior wood frame or a sheet of drywall, is disposed against the inside surface of the window, the additional thickness of the back dam at the bottom of the window results in a gap between the planar member and the window frame at the sides and top of the window. Such a gap reduces the aesthetic appearance of the window installation and/or complicates the installation by requiring additional steps for eliminating or covering the gap.

Thus, there exists a continued need for improvements to such flashings, for example, to facilitate the proper installation of the flashings and to further reduce the likelihood that water will flow to the rough opening in the wall and to the inside of the wall.

SUMMARY OF THE INVENTION

According to one embodiment of the present invention, there is provided a sill flashing for use in the installation of a portal, such as a window, in an opening of a wall. The flashing defines channels for directing water out of the wall, thereby restricting the passage of water into the wall around the portal. As discussed below, the flashing can include one or more integral housing that can be used to overlap an adjacent part of the flashing to prevent leakage at an interface of adjacent parts of the flashing. The flashing can facilitate the installation thereof, e.g., so that the conventional methods for cutting the inner surface of the wall without damaging the flashing, so that the flashing can be installed in a variety of weather condition without tape or adhesives, and/or so that shims can easily be used in connection with the flashing installation.

The flashing of one embodiment generally includes a sill portion that extends in a longitudinal direction and at least one jamb portion disposed at an angle relative to the sill portion. The sill portion is configured to be disposed against a sill of the opening, and an outer surface of the jamb portion is configured to be disposed against one of the jambs of the opening. A front face plate extends from the sill portion and the jamb portion in a plane generally perpendicular to the sill portion and the jamb portion. The sill portion includes a plurality of support portions, each of which extends between a rear end and a front end and between a lower end and an upper end. The lower ends are configured to be disposed against the sill of the opening, and the upper ends are structured to support a portal, such as a window, disposed in the opening on the support portions. For example, each support portion can be a substantially planar vertical portion. A rear dam extends in the longitudinal direction and proximate the rear ends of the support portions, and a plurality of base portions are provided, each base portion extending between adjacent support portions and disposed at an angle relative to the lower ends of the support portions so that each base portion and the adjacent support portions define a channel structured to direct water toward and through the front face plate. At least one integral housing of the sill portion is configured to overlap an adjacent one of the support portions so that the flashing can be disposed in at least two parts that define an interface therebetween, with the housing being configured to prevent water disposed on the flashing from passing through the interface to the sill of the opening. The sill portion can define two integral housings, and each integral housing can have a different length in the longitudinal direction of the sill portion. For example, the housing can define a cover portion that extends in the longitudinal direction of the sill portion and two side walls that each extend from the cover portion generally perpendicular to the longitudinal direction of the sill portion, with the rear dam defining a slot between the two side walls such that the housing can be disposed over at least one of the support portions.

The rear dam and the front face plate can define offset portions between the two side walls. The offset portion of the rear dam can be offset in a transverse direction relative to adjacent portions of the rear dam, the transverse direction being perpendicular to the longitudinal direction of the sill portion. The offset portion of the front face plate can be offset in a transverse direction relative to adjacent portions of the front face plate.

Each support portion can define a trim feature, such a shoulder or groove, that extends in a direction between the rear and front ends and is configured to facilitate removal of the upper end of the support portion. The sill portion defines score lines on opposite sides of each housing. The front face plate can also define a plurality of trim features to facilitate removal of a longitudinal portion of the flashing.

The rear dam can be configured to define a top edge that is substantially coplanar with the upper end of the support portions so that the support portions and the rear dam are configured to cooperatively provide support for a portal disposed in the opening. In some cases, the sill portion defines a dam height of at least ⅜ inch when the lower ends of the support portions are disposed horizontally on the sill of the opening, the dam height being measured in a vertical direction from a top of the rear dam to an intersection of the base portions and the front face plate. The rear dam can define an offset portion proximate the jamb portion that is offset in a direction toward the front face plate, and/or the rear dam can define a reinforcement member proximate the jamb portion, e.g., to prevent cutting or other damage to the rear dam during drywall installation.

The flashing can define two of the jamb portions, each jamb portion at a longitudinally opposite ends of the sill portion, and each jamb portion disposed at a substantially right angle relative to the sill portion so that the outer surface of each jamb portion is configured to be disposed against a respective one of the jambs of the opening when the sill portion is disposed against the sill of the opening. Further, both jamb portions, the sill portion, and the front face plate can be formed as integral members formed of a polymer.

According to one embodiment, the sill portion also defines a longitudinal shelf that extends from the rear dam in a direction opposite the front face plate. As described below, the shelf can increase the usefulness of the flashing, e.g., by allowing a flashing with a particular configuration to be used in different installations with windows or other portals of various dimensions. The shelf can define a gap proximate each housing.

According to a method of one embodiment of the present invention, the portal is installed in a wall opening, the opening being defined by a sill and jambs extending from the sill to define corners with the sill. The method generally includes providing a flashing having a front face plate, two jamb portions perpendicular to the front face plate, and a sill portion generally perpendicular to the front face plate and extending in a longitudinal direction between the two jamb portions. The sill portion defines a plurality of channels structured to direct water toward and through the front face plate, and the sill portion defines a plurality of support portions and at least one integral housing. The support portions are configured to support the portal and define channels structured to direct water toward and through the front face plate. The method includes cutting the flashing proximate the integral housing to thereby separate the flashing into first and second parts, each part including one of the jamb portions and part of the sill portion, and the first part including the integral housing. The second part of the flashing is trimmed according to a predetermined dimension of the opening, and a discardable portion of the second part is removed therefrom. The two parts of the flashing are disposed in the opening of the wall so that the sill portion is disposed horizontally against the sill of the opening, each jamb portion is disposed vertically against a respective one of the jambs of the opening, and the front face plate is disposed against an outer surface of the wall. The housing of the first part of the flashing overlaps a respective one of the support portions defined by the second part of the flashing so that the flashing is configured to prevent water disposed on the flashing from passing through an interface defined between the two parts of the flashing to the sill of the opening. An upper end of the respective support portions of the second part of the flashing can be trimmed, e.g., so that the housing can overlap the support portion. The portal can be disposed in the opening on uppers ends of the support portions.

In some cases, at least one shim is disposed under the portal. For example, the shim can be inserted between the flashing and the portal after the portal is disposed on the flashing, in a direction from the inner surface of the wall outward toward an outer surface of the wall and the front face plate disposed thereon. Alternatively, the shim can be disposed between the flashing and the opening, i.e., opposite the flashing from the portal. In some cases, at least one fastener can be inserted through the face plate and into the wall to secure the flashing to the wall before the shim is disposed.

The flashing can be cut according to the desired length of the flashing and, in some cases, the method can include selectively cutting the flashing proximate one of two integral housings, which can be of different length, according to the desired length of the flashing.

A longitudinal shelf can extend from the rear dam in a direction opposite the front face plate, and the method can include trimming the shelf so that the sill flashing extends by a predetermined dimension from the front face plate into the opening.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, but which are not necessarily drawn to scale, wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
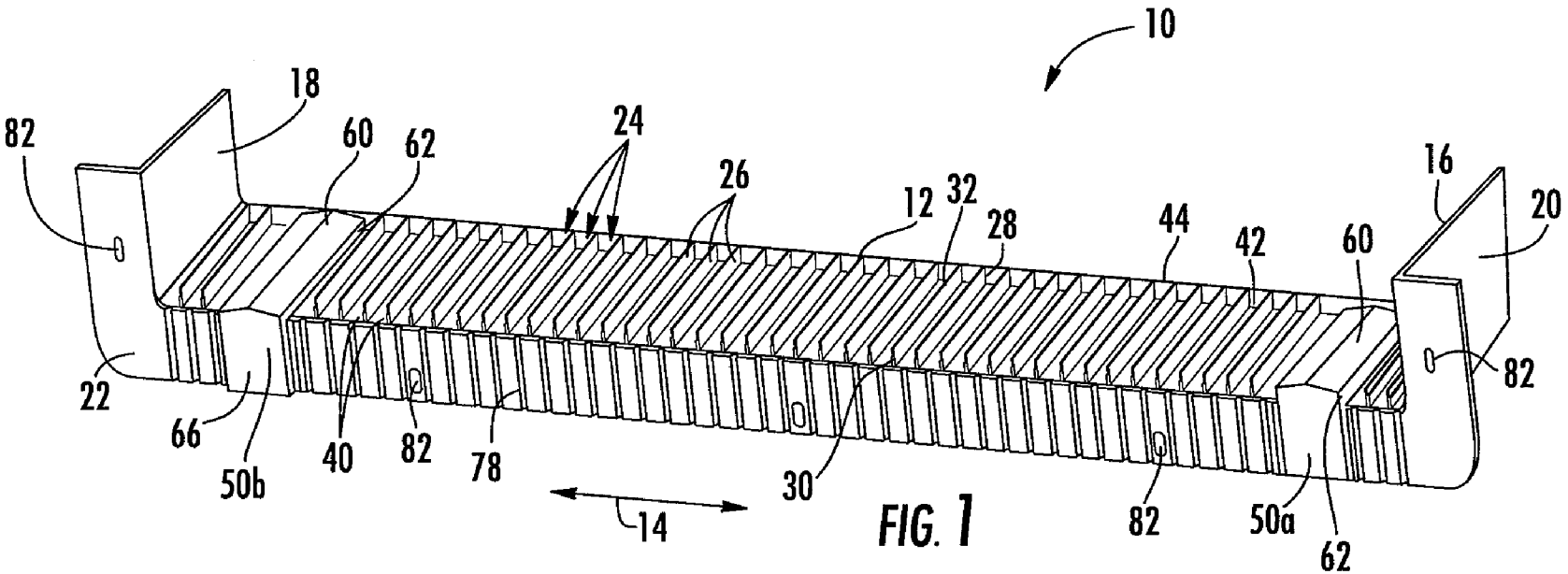
FIG. 1 is a perspective view illustrating a sill flashing according to one embodiment of the present invention.

Referring to the drawings and, in particular, to FIG. 1, there is shown a sill flashing 10 according to one embodiment of the present invention. The sill flashing 10 is structured to be installed in an opening 110 in a wall 112 in connection with the installation of a window 114 (FIGS. 9-11) or other portal in the opening 110 so that the sill flashing 10 directs water out of the opening 110, e.g., to the outside of a building. Accordingly, the flashing 10 is preferably formed of a waterproof material. For example, the sill flashing 10 can be formed of a variety of materials including polymers, metals, and the like. In one advantageous embodiment of the invention, the sill flashing 10 is formed as a single unitary member of plastic, such as polypropylene, polyethylene, polystyrene, or polyvinyl chloride (PVC). For example, the flashing 10 can be formed by a conventional injection molding operation using one or more dies that cooperably define a die cavity corresponding to the configuration of the flashing 10 so as to form the flashing 10 as a unitary, relatively rigid, molded plastic member.

Figure 9:
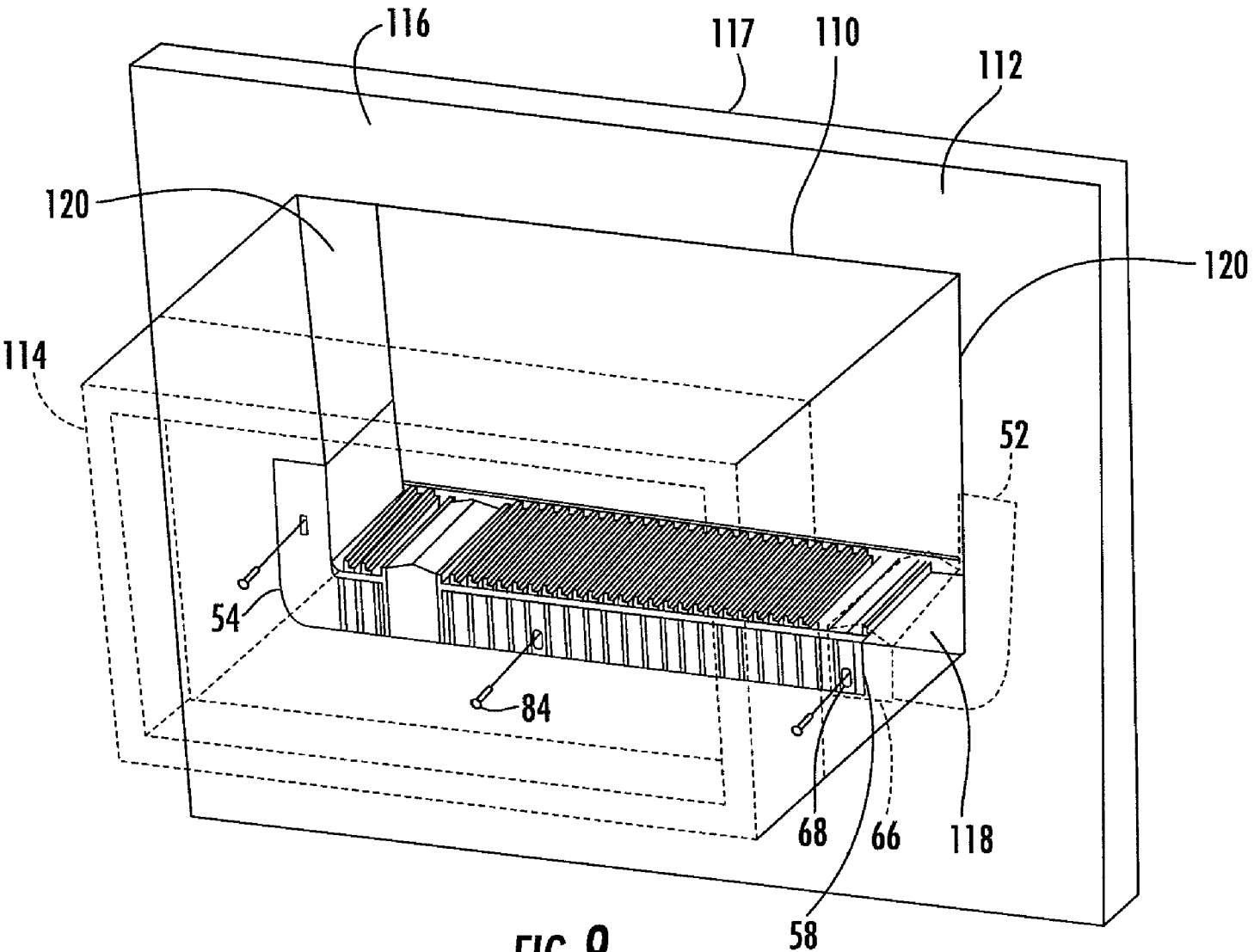
FIG. 9 is a perspective view illustrating the sill flashing of FIG. 8 partially installed in a wall opening during construction of a wall assembly according to one embodiment of the present invention.
Figure 10:
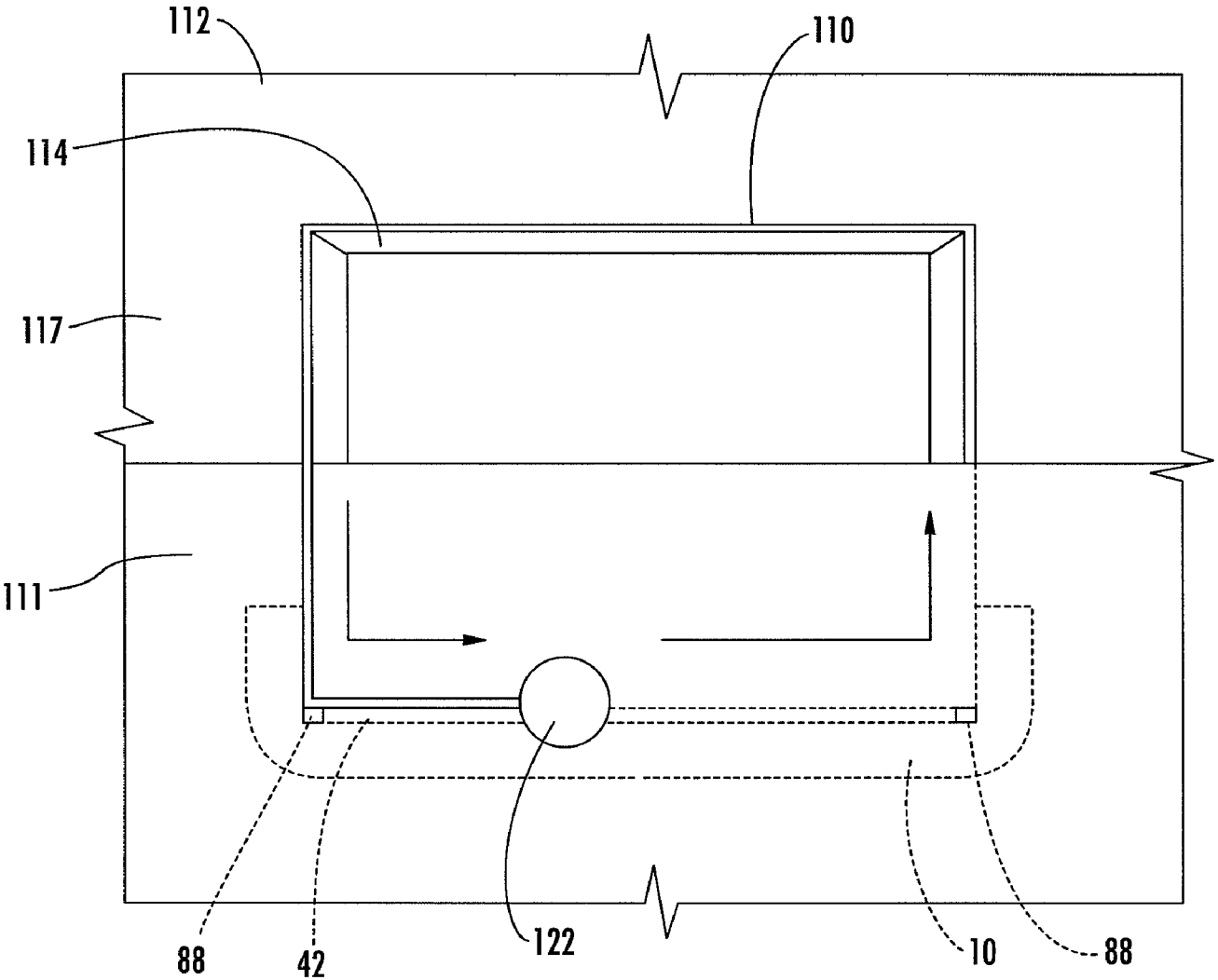
FIG. 10 is an elevation view illustrating the inner surface of the wall having the installed sill flashing of FIG. 9 during removal of a piece of drywall from the inner surface of the wall at the location of the opening.
Figure 11:
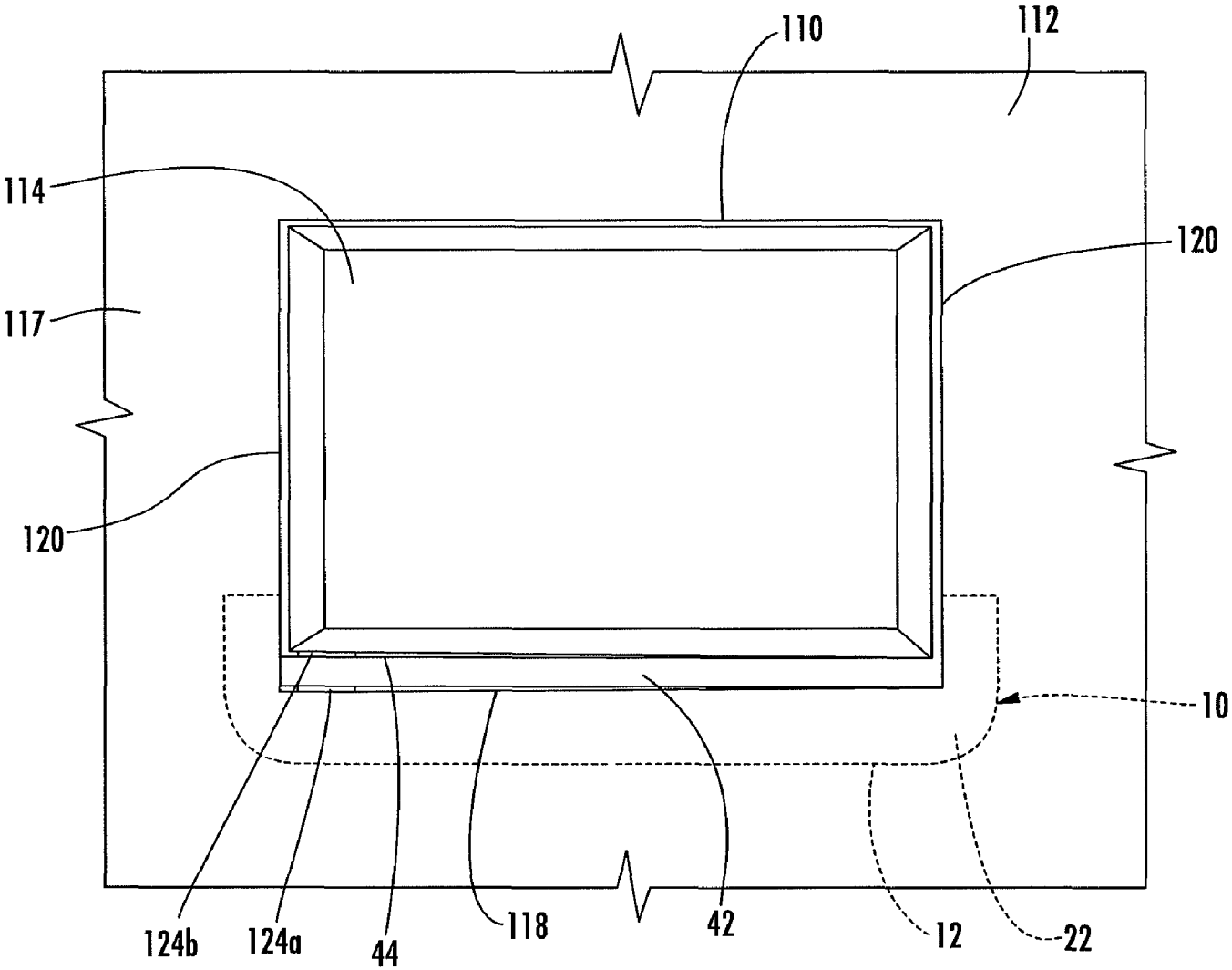
FIG. 11 is an elevation view illustrating the wall of FIG. 10 with the flashing and window installed therein and shims provided to level the window in the opening.
Figure 12:
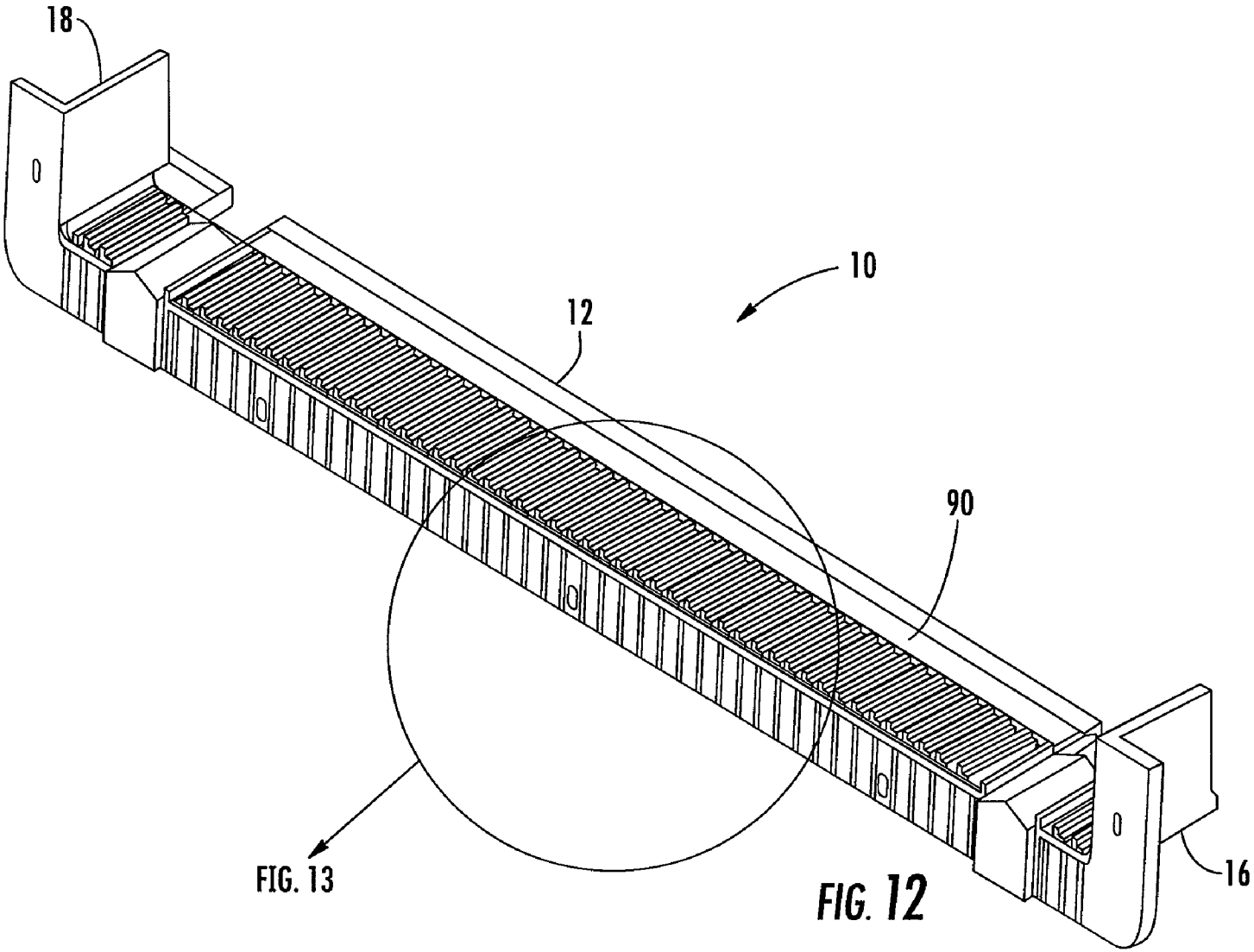
FIG. 12 is a perspective view illustrating a sill flashing according to another embodiment of the present invention, having a shelf extending from the rear dam.
Figure 13:
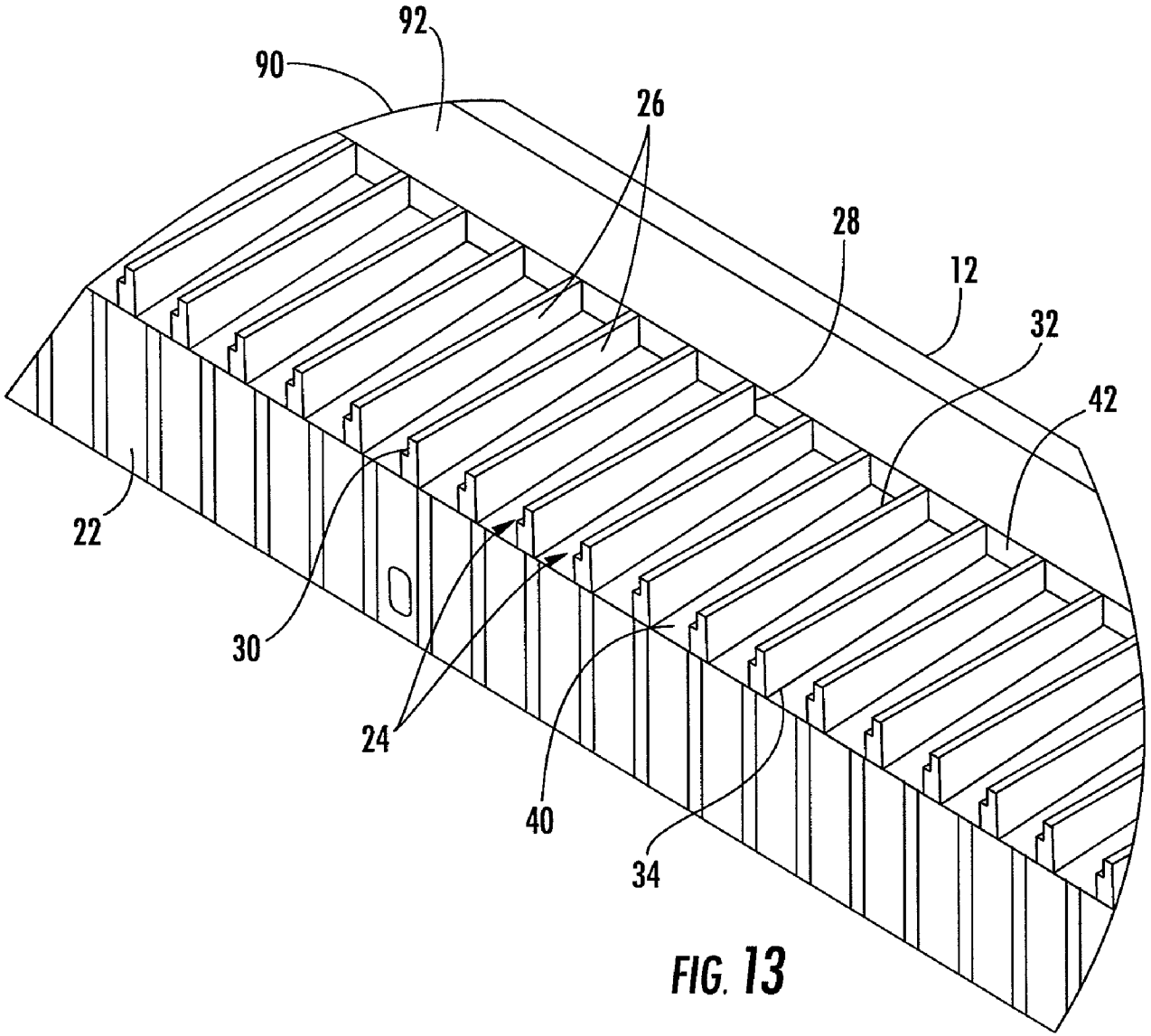
FIG. 13 is an enlarged perspective view partially illustrating the sill portion of the sill flashing of FIG. 12 as indicated in FIG. 12.

In the embodiment illustrated in FIG. 1, the flashing 10 includes a sill portion 12 that extends in a longitudinal direction 14 between two jamb portions 16, 18. Each jamb portion 16, 18 is disposed at an angle relative to the sill portion 12, typically a right angle, so that the flashing 10 can be disposed against a horizontal sill of the opening 110, and an outer surface 20 of each jamb portion 16, 18 can be disposed against a respective one of the jambs of the opening 110. The flashing 10 also includes a front face plate 22 that extends from the sill portion 12 and the jamb portions 16, 18. The front face plate 22 extends in a plane that is generally perpendicular to the sill portion 12 and the jamb portions 16, 18 so that, when the flashing 10 is placed in the opening 110, the front face plate 22 can be disposed against an outer surface 116 of the wall 112 while the sill portion 12 is disposed against a sill 118 of the opening 110 and the jamb portions 16, 18 are disposed against the jambs 120 of the opening 110, as shown in FIGS. 9-11. In this way, the flashing 10 can provide a continuous barrier across the bottom of the opening 110 to prevent water from passing to the wall 112 at the bottom of the opening 110, including the sill 118 and the corners of the opening 110 where the sill 118 and jambs 120 intersect.

The sill portion 12, which is configured to support the window 114 or other portal in the opening 110, defines a plurality of channels 24 for directing water toward and through the front face plate 22. As illustrated in FIG. 1, the sill portion 12 includes a plurality of support portions 26. Each support portion 26 extends between a rear end 28 and a front end 30 and between an upper end 32 and a lower end 34. In the illustrated embodiment, each support portion 26 is a planar, rectangular member disposed in a plane that is perpendicular to the sill 118 of the opening 110 and parallel to the jambs 120 (i.e., typically vertical); however, it is appreciated that the support portions 26 can have other configurations.

Base portions 40 are disposed between each adjacent pair of support portions 26, with each base portion 40 disposed at an angle relative to the lower ends 34 of the support portions 26 so that each base portion 40 and the two adjacent support portions 26 define one of the channels 24 therebetween, which is structured to direct water toward and through the front face plate 22. In the illustrated embodiment, the base portions 40 are coplanar and define a plane perpendicular to the support portions 26 and angled acutely relative to the sill 118 of the opening 110. In other words, the depth of each channel 24 increases in a direction toward the front face plate 22 such that the depth of each channel 24 relative to a horizontal plane above the channel 24 defines an increased depth at the front face plate 22 and a decreased depth with increasing distance from the front face plate 22. Thus, water in the channels 24 tends to flow toward the front face plate 22 and exits the channels 24 through the front face plate 22.

The sill portion 12 of the flashing 10 also includes a rear dam 42 that extends in the longitudinal direction and proximate the rear ends 28 of the support portions 26. The rear dam 42 can define a top edge 44 that is higher than the topmost portion of the base portions 40 so that the rear dam 42 partially defines the channels 24. In some cases, the top edge 44 of the rear dam 42 can be as high as the upper ends 32 of the support portions 26 so that the top edge 44 of the rear dam 42 and the upper ends 32 of the support portions 26 are coplanar to cooperatively define a support for the window 114 or other portal disposed in the opening 110. That is, with the lower end 34 of each support portion 26 disposed against the sill 118 of the opening 110, the upper ends 32 of the support portions 26 can be disposed in a plane with the top edge 44 of the rear dam 42 so that the flat, horizontal bottom of the window 114 can rest thereon. In embodiments where the rear dam 42 is configured to support the window 114, the rear dam 42 is typically configured to be disposed under the window 114 and, unlike conventional back dams, typically is not configured to extend upward beyond the bottom of the window 114 to contact the inside surface of the window 114. Thus, unlike conventional back dams that contact the inside surface of the window, the rear dam 42 of the present invention can prevent water entry while not requiring additional space at the back of the window. Further, as described below, any height of the rear dam 42 can be provided.

Figure 22:
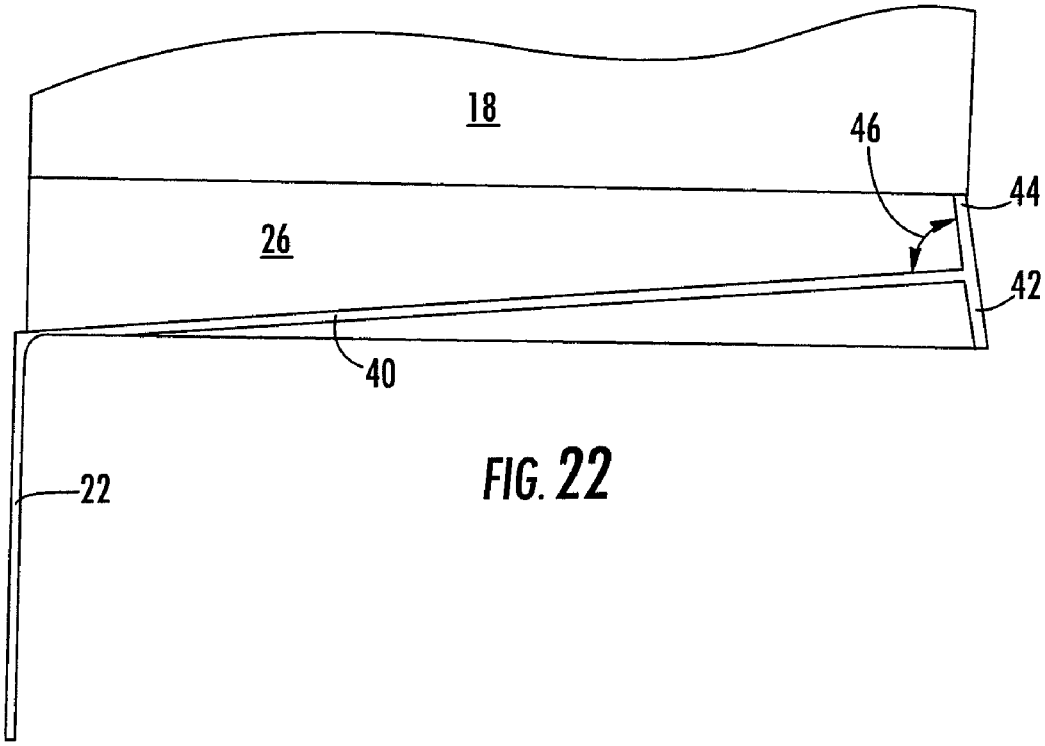
FIG. 22 is a partial section view illustrating a flashing according to another embodiment similar to that of FIG. 1 and defining the rear dam at an angle relative to the vertical direction.
Figure 23:
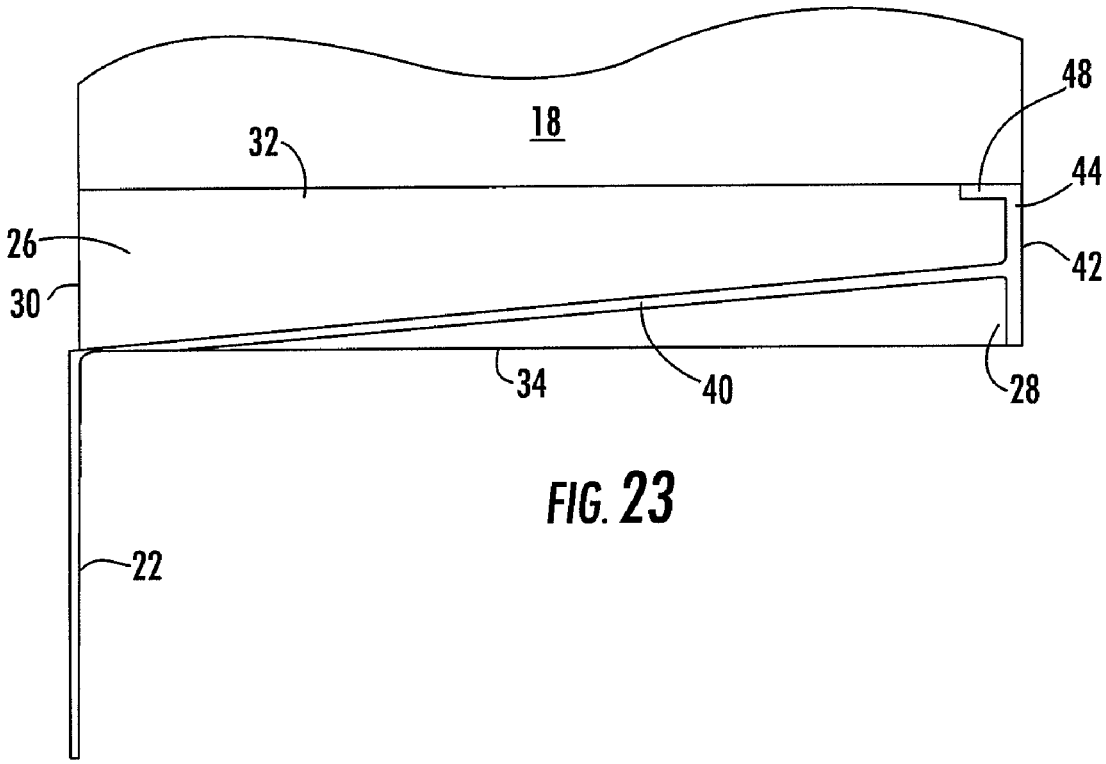
FIG. 23 is a partial section view illustrating a flashing according to another embodiment similar to that of FIG. 1 and defining a return flange extending forwardly from the rear dam.

In some embodiments, the rear dam 42 can be angled toward the front face plate 22 to further reduce the likelihood of water intrusion. For example, as illustrated in FIG. 22, the rear dam 42 can be disposed at an angle so that, when the sill portion 12 is disposed horizontally with the front face plate 22 vertical and the upper ends of the support upper ends 32 of the support portions 26 horizontal, the rear dam 42 is disposed in a non-vertical configuration and the top edge 44 of the rear dam 42 is inclined toward the outer surface 116 and the front face plate 22. An angle 46 defined between the rear dam 42 and the base portions 40 can be 90°, more than 90°, or less than 90°. The angled orientation of the rear dam 42 can provide an increased "effective" dam height, i.e., a characteristic for preventing water intrusion over the rear dam 42 that is typical of flashings having greater (vertical) dam heights. In addition, or in alternative, to the angled configuration of the rear dam 42, the flashing can include a return flange 48 that extends forwardly from the rear dam 42 to operate as a splash guard, as shown in FIG. 23. As illustrated, the return flange 48 can extend from the top edge 44 of the rear dam 42 horizontally toward the plane of the front face plate 22. In other embodiments, the flange 48 can be connected to the rear dam 42 at a position that is lower than the upper edge 44 and/or the return flange 48 can be disposed at an angle relative to the horizontal direction. In either case, the return flange 48 can increase the effective dam height of the flashing so that the flashing prevents water from passing over the rear dam 42 even during harsh weather conditions. While the present application is not bound by any particular theory of operation, it is believed that the angling of the rear dam 42 and/or the provision of the return flange 48 can increase the effective dam height by defining an increased distance over which water in one of the channels must travel to pass over the rear dam 42. For example, in the case of an angled rear dam 42, the length of the rear dam 42 is greater than its height. In the case of the rear dam 42 and return flange 48, water on the support portion must flow up the rear dam 42 and forward along the return flange 48 to pass over the dam 42. In some cases, flashings having rear dams 42 of these configurations can provide the equivalent protection as other flashings having much larger dam heights.

Figure 8:
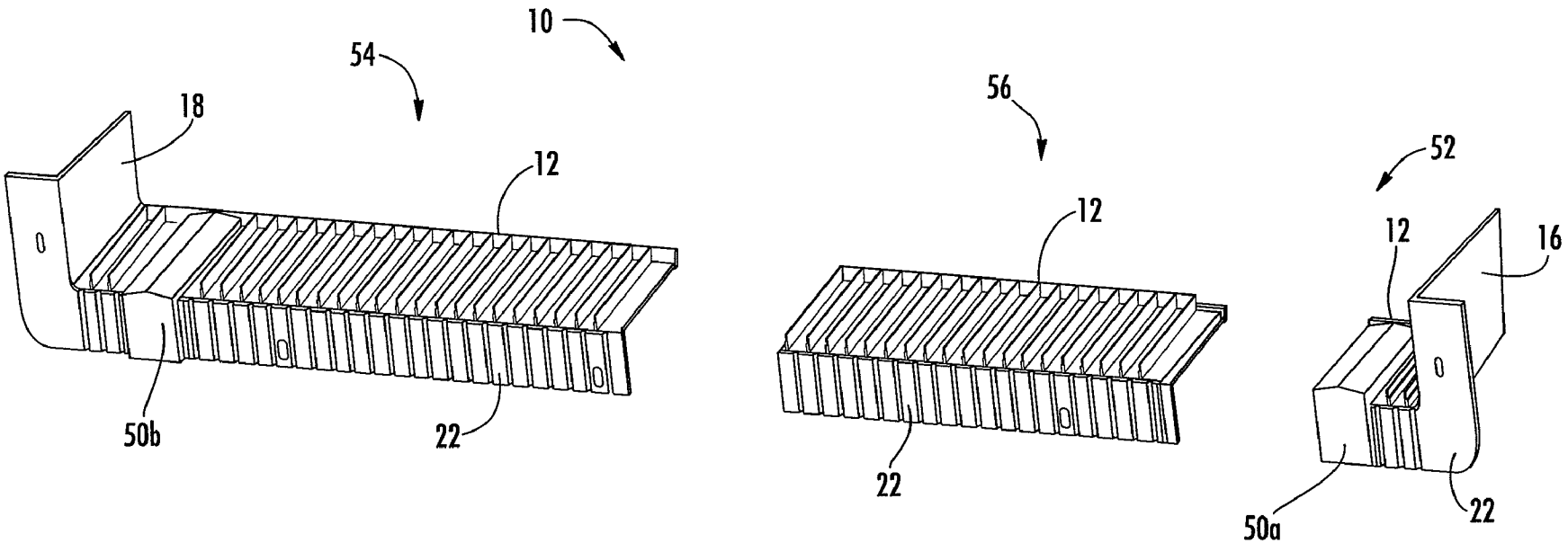
FIG. 8 is a perspective view illustrating the sill flashing of FIG. 1 after being cut into first and second parts and a discardable portion.

The sill portion 12 also defines at least one integral housing that is configured to overlap one or more of the support portions 26 when the flashing 10 is disposed in multiple parts. By the term "integral," it is meant that the housing is unitarily formed with the sill portion 12 such that the housing and sill portion 12 define a single unitary member. As shown in FIG. 1, the flashing 10 defines a first housing 50*a* near the first jamb portion 16 and a second housing 50*b* near the second jamb portion 18, the two housings 50*a*, 50*b* also being collectively referred to herein by reference numeral 50. As discussed further below, the flashing 10 can be provided as a single unitary member or as multiple separate members. In the first case, the flashing 10 can be provided as a single unitary member that defines both jamb portions 16, 18, the sill portion 12, and the front face plate 22. During installation of the flashing 10, it may be necessary to adjust the size of the flashing 10 according to the size of the opening 110 in the wall 112. For example, in one embodiment, the flashing 10 is molded as a single unitary member, and the sill portion 12 has a length of about 40 inches. When this flashing 10 is used in an opening 110 that has a sill 118 shorter than 40 inches (measured from jamb 120 to jamb 120), the flashing 10 can be cut and trimmed to size. In particular, as shown in FIG. 8, the sill portion 12 can be cut in a transverse direction (i.e., perpendicular to the longitudinal direction of the sill portion 12). The sill portion 12 is typically cut proximate one of the housings 50, e.g., the first housing 50*a* as shown in FIG. 8.

Once cut, the flashing 10 defines first and second parts 52, 54. Each part 52, 54 of the cut flashing 10 includes one of the jamb portions 16, 18 and part of the sill portion 12 so that each part 52, 54 can be disposed at a respective one of the corners of the opening 110 in the wall 112. The length of at least one of the parts 52, 54 can be reduced by removing a discardable portion 56, i.e., by cutting the sill portion 12 and discarding the discardable portion 56. The first and second parts 52, 54 can be disposed in an overlapping configuration, e.g., with the first and second parts 52, 54 disposed to define an interface 58 therebetween and the housing 50*a* of the first part 52 overlapping at least one of the support portions 26 of the second part 54 to prevent water from passing through the flashing 10 at the interface 58.

Each housing 50 can be shaped to correspond to the end of the second part 54 of the flashing 10, e.g., to accommodate one or more of the support portions 26 of the second part 54. For example, as shown in FIGS. 2-7, each housing 50 defines a cover portion 60 and side walls 62 that extend therefrom to connect the cover portion 60 to the adjacent base portions 40. The cover portion 60 can be pitched or angled toward one or both of the side walls 62 so that water disposed on the cover portion 60 tends to flow toward the adjacent channels 24. Each housing 50 can be configured so that the peak of the cover portion 60 is no higher than the upper ends 32 of the support portions 26 when the sill portion 12 is disposed on the horizontal sill 118 of the window 114 opening 110, and the side walls 62 can be slightly shorter than the support portions 26.

Figure 5:
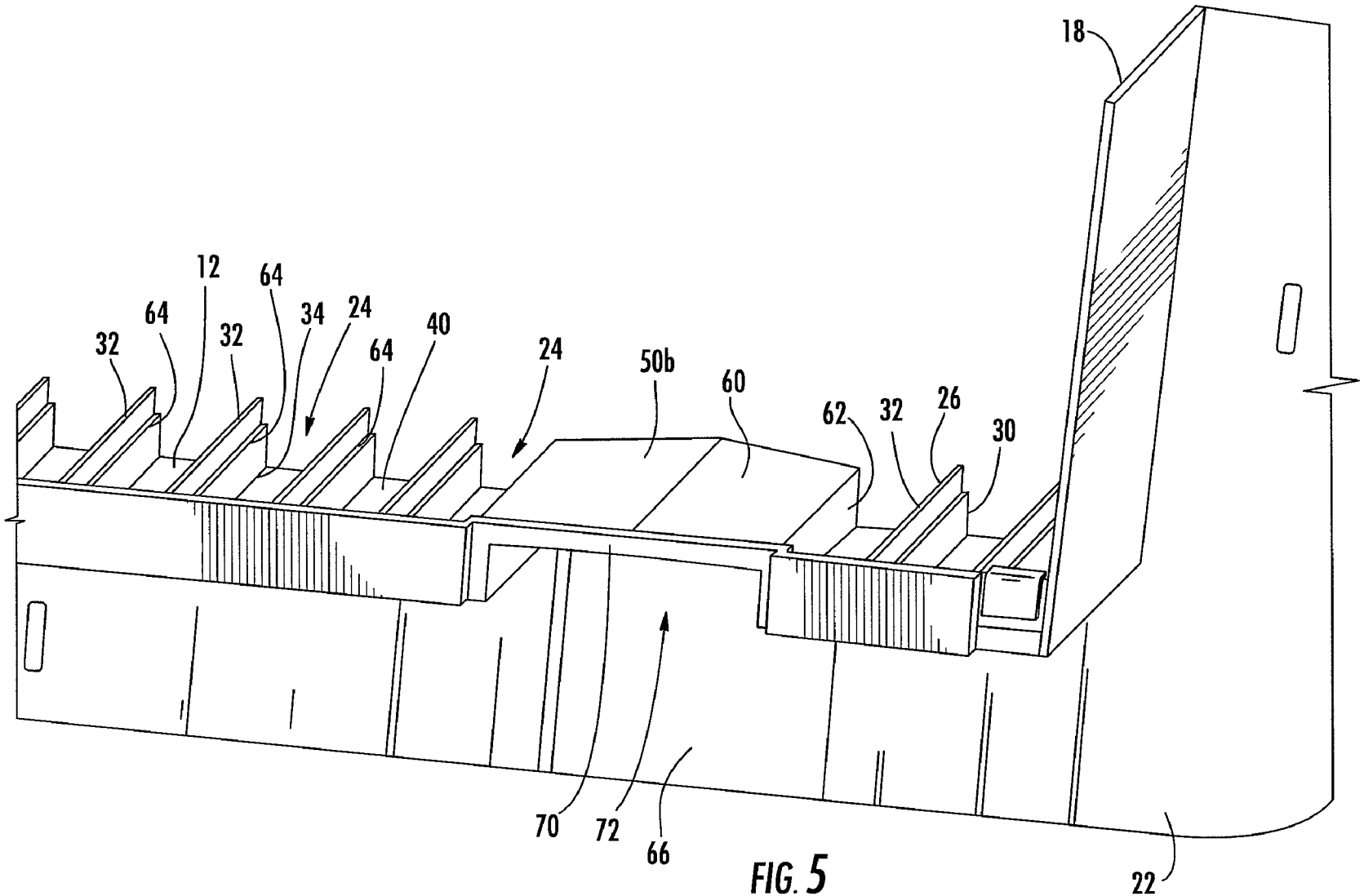
Figure 6:
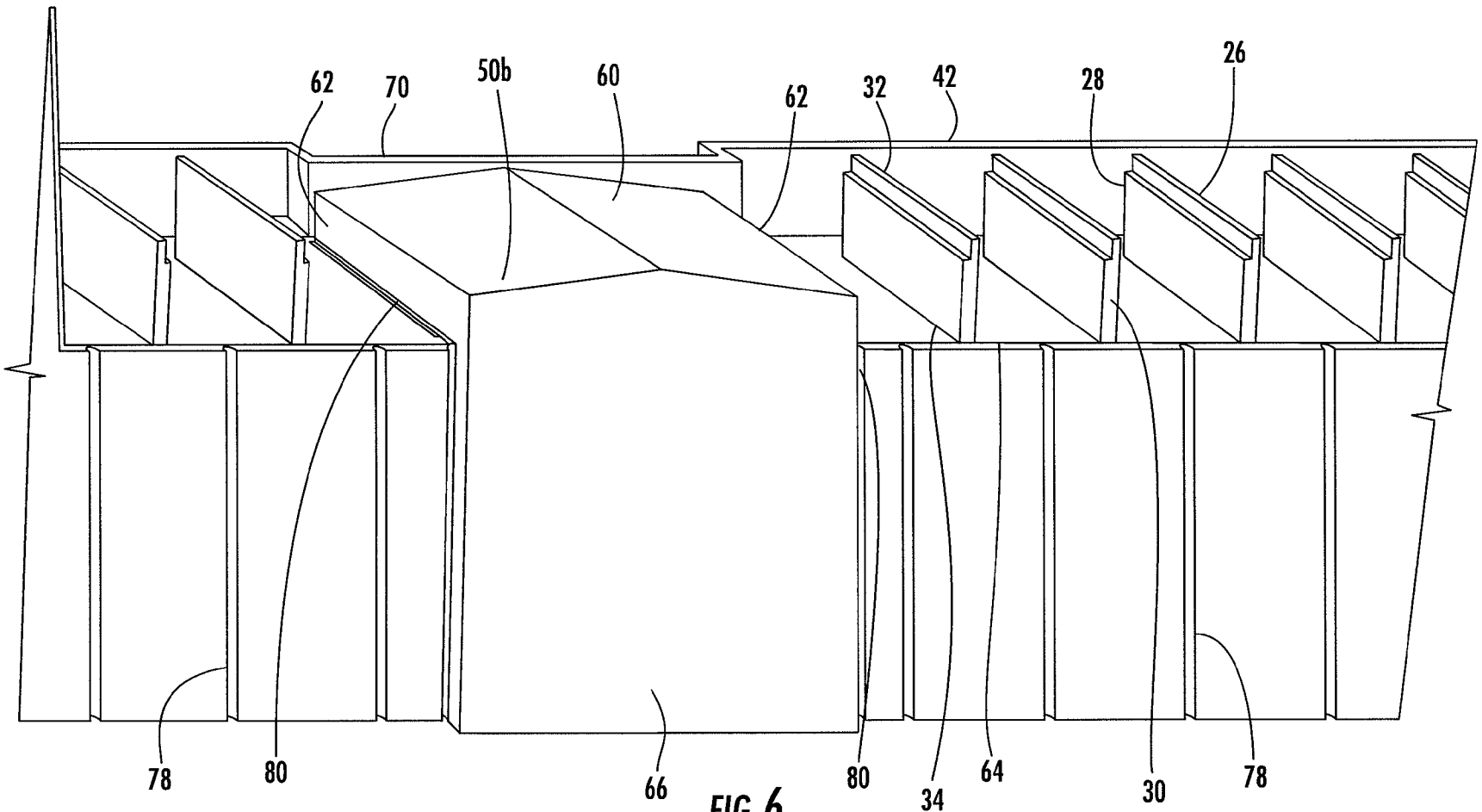
Figure 7:
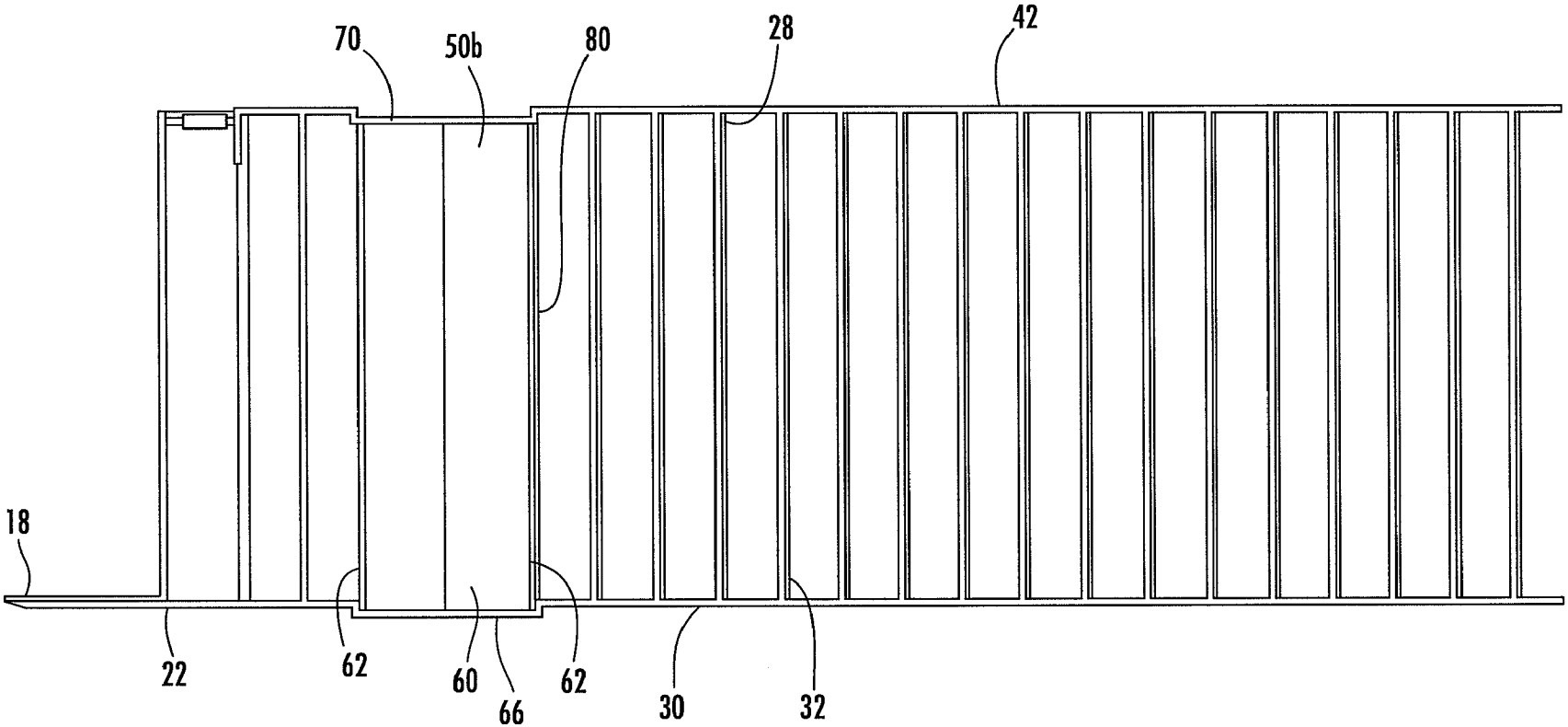

In some cases, one or more of the support portions 26 can be trimmed so that the support portion 26 fits under the housing 50. In this regard, each support portion 26 can define a trim feature, such as a shoulder, score line, perforations, or other feature that facilitates the cutting of the support portion 26 at a predetermined position to remove part of the upper end 32 of the support portion 26. As shown in FIGS. 5 and 6, each of the support portions 26 can have a greater thickness at its lower end 34 and a thinner thickness at its upper end 32 so that each support portion 26 defines a shoulder 64 at the interface 58 of the dissimilar thicknesses. During installation, a person can easily cut the support portion 26 along the shoulder 64, using the shoulder 64 as a guide for the cut.

Figure 2:
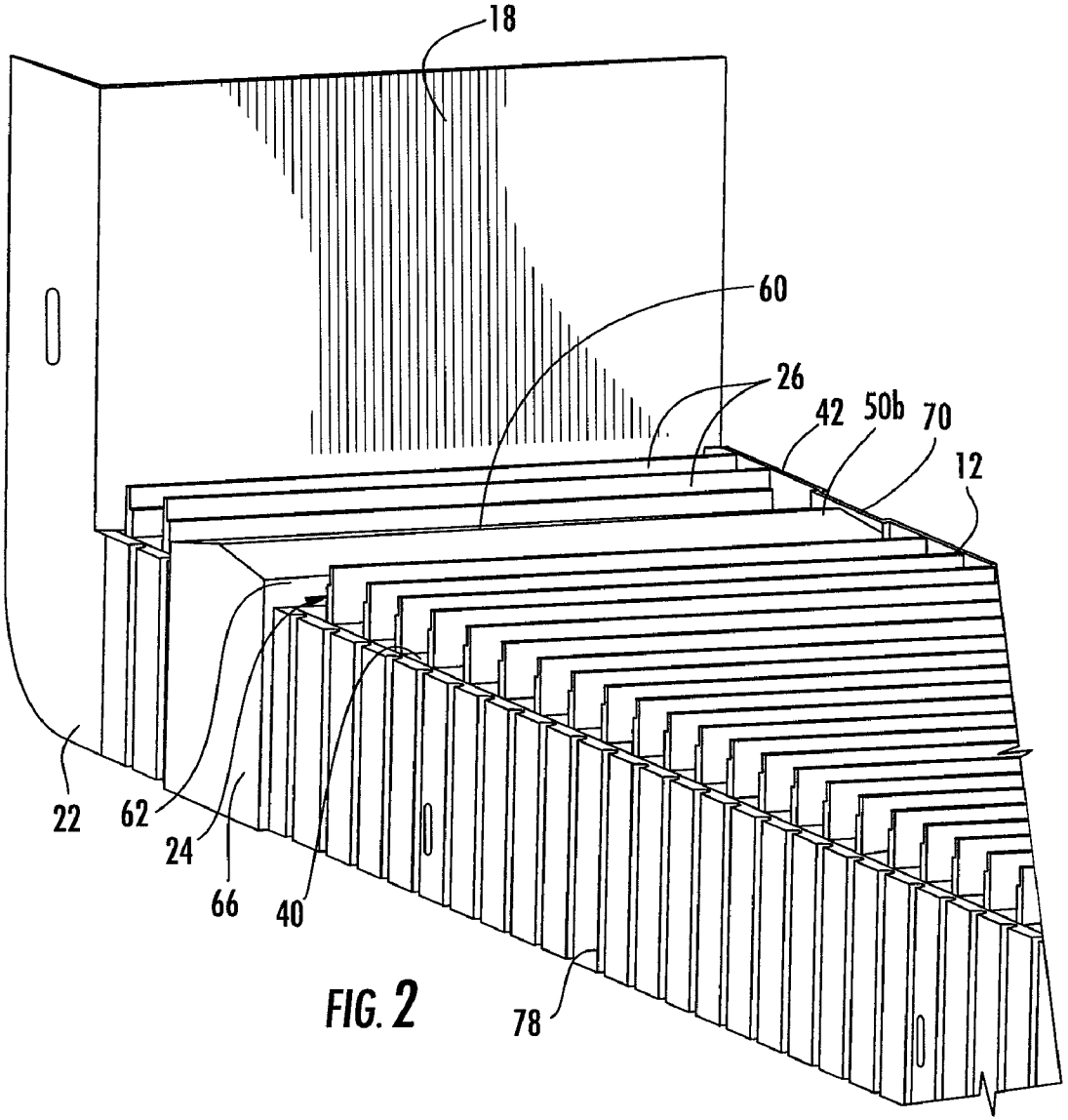
FIG. 2-7 are perspective views partially illustrating the sill flashing of FIG. 1.
Figure 3:
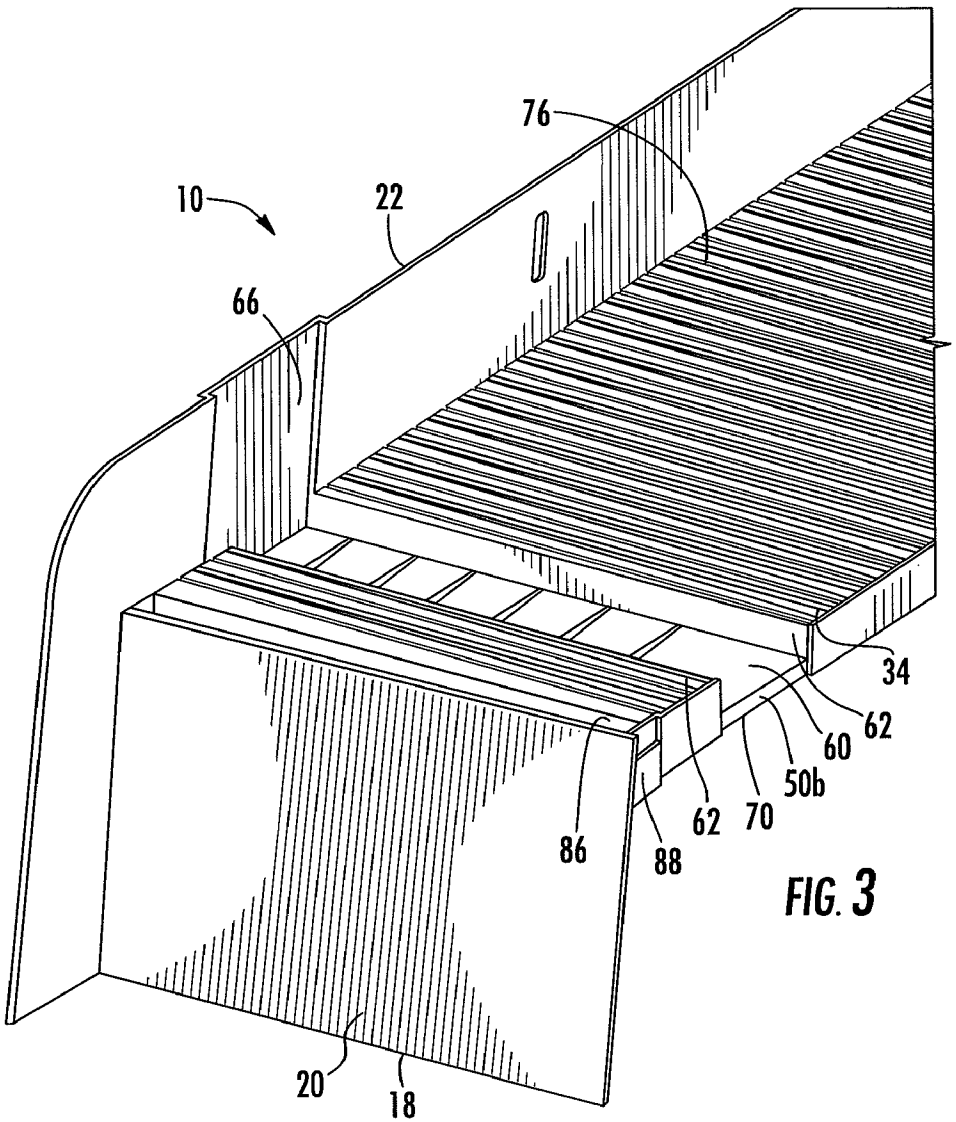
Figure 4:
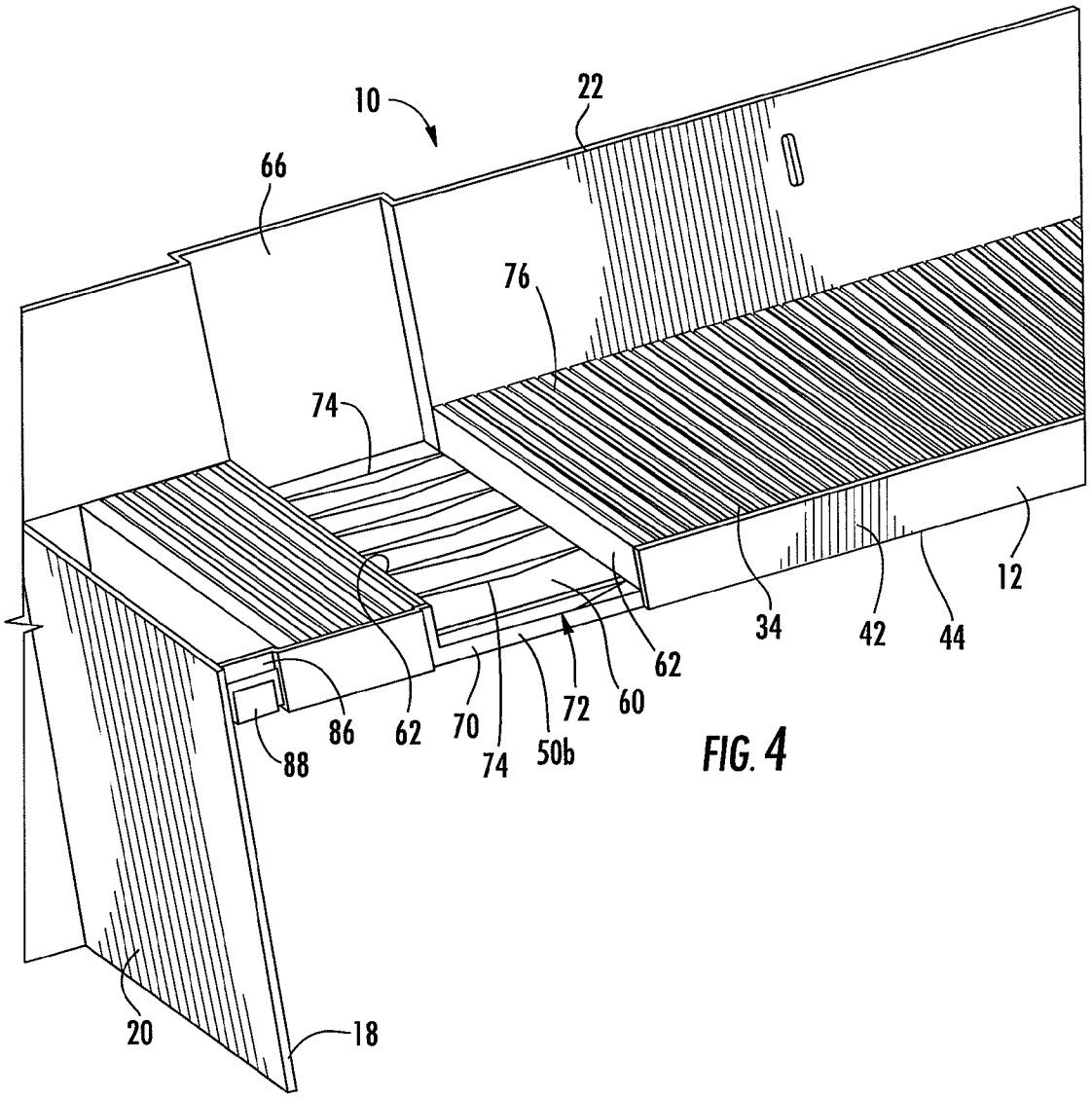

The rear dam 42 and the front face plate 22 can also be configured to facilitate the placement of the housing 50 in an overlapping relationship with another part of the flashing 10. For example, as shown in FIGS. 2-4, the rear dam 42 and the front face plate 22 can be offset at positions proximate the housing 50. That is, a region 66 of the front face plate 22 that adjoins the cover portion 60 of the housing 50 can be offset transversely from the adjacent regions of the front face plate 22. In this way, when the housing 50 is positioned to overlap part of the sill portion 12, the region 66 of the front face plate 22 proximate the housing 50 can be disposed to overlap the front face plate 22 of the overlapped part of the sill portion 12. In other words, an overlapped region 68 of the front face plate 22 can be disposed between the outer surface 116 of the wall 112 and the offset region 66 of the front face plate 22 that extends from the housing 50.

Similarly, a region 70 of the rear dam 42 that adjoins the cover portion 60 of the housing 50 can be offset transversely from the adjacent regions of the rear dam 42 so that, when the housing 50 is positioned to overlap part of the sill portion 12, the region 70 of the rear dam 42 proximate the housing 50 can be disposed in an offset relationship relative to the adjacent region of the rear dam 42 of the overlapped part of the sill portion 12. In other words, the region 70 of the rear dam 42 extending from the cover can be disposed offset slightly in the direction of the front face plate 22 relative to the other regions of the rear dam 42.

Further, the region 70 of the rear dam 42 extending from the cover portion 60 of the housing 50 can define a slot 72 (FIG. 5) between the two side walls 62 of the housing 50. In this way, when the housing 50 is disposed to overlap one of the support portions 26, the support portion 26 can be disposed in the slot 72 of the rear dam 42 so that the rear dam 42 does not interfere with the support portion 26. As noted above, the height of the support portion 26 can be reduced by trimming, such that the slot 72 of the rear dam 42 need only accommodate the reduced height of the support portion 26. The cover portion 60 of the housing 50 can be reinforced by gussets or other reinforcement members 74, and the reinforcement members 74 can be configured to rest on the top of the shortened support portion 26 that is overlapped by the cover portion 60.

The flashing 10 can be manufactured and/or provided to an installer as several distinct components such that multiple members are assembled or otherwise configured in combination to provide a flashing for a single sill. For example, separate members can be provided for the two corners at the bottom of the opening, such as by manufacturing and/or providing the first and second parts 52, 54 of the flashing 10 as separate components for installation. One or both of the parts 52, 54 can be trimmed during installation according to the dimensions of the opening 110 in the wall 112. Alternatively, as discussed above, the flashing 10 can be manufactured and provided as a single unitary member that integrally includes the front face plate 22 and both jamb portions 16, 18 connected by the sill portion 12, as shown in FIG. 1. The flashing 10 can be used for windows of various sizes, and the installer typically cuts and trims the flashing 10 as described above according to the size of the opening 110 in the wall 112 and the window 114. Trim features can be provided in the sill portion 12 to facilitate the cutting and trimming. For example, as shown in FIG. 4, a groove 76 can be provided in each base portion 40 extending between the rear dam 42 and the front face plate 22, and corresponding grooves 78 (FIG. 6) can be provided in the front face plate 22 and/or the rear dam 42. The grooves 76, 78 can be provided on either surface of the flashing 10, i.e., on a surface that is directed toward or away from the wall 112. The installer can easily cut the sill portion 12 along the grooves 76, 78, e.g., using a knife or other cutting tool, using the grooves 76, 78 as a guide for the cut. In other embodiments, other trim features can be provided instead of grooves, such as a shoulder or other variations in thickness or material property.

The unitary flashing 10 of FIG. 1 includes two of the integral housings 50 in the sill portion 12. Grooves 80 are provided proximate the side walls 62 of each integral housing 50 to facilitate cutting the sill portion 12 along either side wall 62. In a typical method of installation, the sill portion 12 is cut along on of the grooves 80 along one side of one of the housings 50 so that the housing 50 is disposed on one part 52, 54 of the flashing 10 and the other part 52, 54 of the flashing 10 can be trimmed as described above by removing one or more of the support portions 26 and base portions 40. By trimming and discarding a select length of the discardable portion 56 of the sill portion 12, the flashing 10 can be re-sized to accommodate openings 110 and windows of various sizes.

In some cases, each housing 50 can be large enough to overlap more than one of the support portions 26 so that, once trimmed, the flashing 10 can be adjusted slightly to the exact size of the opening 110 by selectively overlapping one or more of the support portions 26. Further, the two housings 50 of the flashing 10 can be different in size, e.g., so that the dimension of each housing 50 between the two side walls 62 is different, and the housings 50 can be used to accommodate different degrees of adjustments. For example, the first housing 50*a* can be longer in the longitudinal direction of the sill portion 12 than the second housing 50*b*. In particular, the dimensions of the flashing 10 and the opening 110 in the wall 112 may be such that, if the sill portion 12 is cut proximate the first housing 50*a* and the necessary length of the sill flashing 10 is removed proximate the cut as described above, the side wall 62 of the first housing 50*a* that partially overlaps the adjacent part 54 of the flashing 10 may tend to interfere with one or more of the support portions 26 that are overlapped by the cover portion 60 when the jamb portions 16, 18 of the two parts 52, 54 of the flashing 10 are disposed against the jambs 120 of the opening 110. In this case, an adjustment of the length of the sill portion 12 can be achieved by cutting the sill portion 12 proximate the second housing 50*b*. The second housing 50*b* is sized differently than the first housing 50*a* so that the side wall 62 of the second housing 50*b* that overlaps an adjacent portion of the first part 52 does not interfere with any of the support portions 26 when the jamb portions 16, 18 of the two parts 52, 54 of the flashing 10 are disposed against the jambs 120 of the opening 110.

The flashing 10 is typically cut proximate one of the housings 50 during installation. That is, as described above, the flashing 10 can be cut on either side of one of the housings 50, and a length of the sill portion 12 (i.e., discardable portion 54) is then trimmed and removed from the other part of the flashing 10, and the housing 50 covers the interface 58 defined between the two parts 52, 54 of the flashing 10. In some case, however, the flashing 10 can be cut proximate both housings 50, and both housings 50 can be used to cover a respective one of the interfaces 58 that is formed between the three or more adjacent parts of the flashing 10.

The flashing 10 is configured to support the window 114 or other portal in the opening 110 of the wall 112. For example, as noted above, the lower ends 34 of the support portions 26 can be disposed on the sill 118 of the opening 110, and the upper ends 32 of the support portions 26 can generally be disposed in a common plane to define a support for the bottom of the window 114. In other words, the rear dam 42 can be configured to extend not higher than (or not substantially higher than) the supported position of the bottom of the window 114. Thus, even after the flashing 10 and the window 114 are installed in the opening 110 in the wall 112, access is provided to the plane of contact of the flashing 10 and the window 114 so that shims can be inserted between the top of the flashing 10 and the bottom of the window 114 from the interior of the building, i.e., in a direction from the rear dam 42 toward the front face plate 22, as discussed below in connection with FIG. 11.

The front face plate 22 defines apertures 82 for receiving nails 84 or other fasteners therethrough, e.g., to secure the flashing 10 to the wall 112. The apertures 82 can be elongate slots so that, after the nails 84 are disposed through the slots 82, the flashing 10 can still be adjusted vertically.

During installation, the installer can dispose the flashing 10 in the opening 110 in the wall 112, secure the flashing 10 to the wall 112 by inserting nails 84 through the apertures 82, and dispose the window 114 in the opening 110 so that the window 114 is supported by the flashing 10. Thereafter, the position of the window 114 can be adjusted by inserting shims between the window 114 and the opening 110 defined by the wall 112. Shims are typically thin pieces of wood or other materials that are inserted between the window 114 and the periphery of the opening 110 to adjust the location of the window 114 in the opening 110, e.g., to level the window 114 so that the bottom and top of the window 114 are horizontal and the sides are vertical. For example, as shown in FIG. 11, shims 124*a* can be disposed under the window 114 between the opening 110 and the flashing 10, and/or shims 124*b* can be disposed under the window 114 between the flashing 10 and the window 114. Further, the installer can insert the shims 124*a*, 124*b* from the interior side of the opening 110, i.e., in a direction from the inner surface 117 of the wall 112 toward the outer surface 116. If one or more of the shims 124*a* is to be inserted at the bottom of the opening 110, between the opening 110 and the flashing 10, the flashing 10 and the window 114 can be raised slightly as the shim 124*a* is inserted. The adjustment of the flashing 10 relative to the nails 84 disposed through the apertures 82 is accommodated by the elongated shape of the apertures 82. Typically, the nails 84 are initially inserted disposed close to the top of the apertures 82 so that the flashing 10 can be raised, with one or more of the slots 82 being adjusted upward relative to the nail 84 therein. Alternatively, if one or more of the shims 124*b* is to be inserted between the flashing 10 and the window 114, the flashing 10 can remain in position, and the window 114 can be raised slightly as the shim 124*b* is inserted.

The configuration and dimensions of the flashing 10 can be manufactured to achieve any desired dam height. The term "dam height" is generally defined as a measurement of the vertical component of distance between the top of the rear dam 42 to an intersection of the base portions 40 and the front face plate 22, as measured with the flashing 10 disposed on the sill 118 of the opening 110 configured to support the window 114, e.g., with the lower ends 34 of the support portions 26 disposed horizontally on the sill 118 of the opening 110. In other words, the dam height is typically measured in a vertical direction from a top of the rear dam 42 to the bottom of the channel 24 at the front face plate 22.

The dam height is determined by the depth of the channels 24, as defined by the support portions 26 and the rear dam 42. Thus, by providing the support portions 26 and the rear dam 42 with appropriate dimensions and configurations, any desired dam height of the flashing 10 can be achieved. For example, in the illustrated embodiment, the support portions 26 can define any height between the upper and lower ends 34, e.g., between about 0.25 inch and 2.5 inches, such as about ⅜ inch, about 1 inch, or about 2 inches, and the rear dam 42 can define a height that is about the same. A large dam height may be desirable to decrease the likelihood of intrusion of water, even when the flashing 10 is subjected to severe circumstances such as heavy rain and strong winds. If a relatively large dam height is desired, such as a dam height of 2 inches, the opening 110 in the wall 112 can be made to have a vertical size that is at least 2 inches greater than the vertical size of the window 114 so that the flashing 10 and the window 114 can be stacked vertically in the opening 110. In this way, it will be appreciated that any dam height can be provided by the flashing 10, and the dam height is not restricted by the dimensions of the window frame, such as is typically the case for conventional back dams that extend upward beyond the bottom of a window and are disposed against the inside surface of the window frame.

The flashing 10 can also be characterized by a dam height that is impractical, difficult, or impossible to achieve by other flashing devices formed by conventional methods, such as metal flashings that require stamping or grooved plastic flashings formed in molding processes that limit the thickness of the thickest portions of the molded parts. In this regard, it is noted that an increase in the dam height of the flashing 10 of FIG. 1 does not require a corresponding increase in the thickness of any portions of the flashing 10. Accordingly, even if the dam height is increased significantly, the flashing 10 can be formed by a method similar to that used for the illustrated flashing 10.

The channels 24 can be relatively deep. For example, the outlet of each channel 24 at the front face plate 22 can have a depth that is as great as the height of the support portions 26, e.g., 0.25 inches or more, and in some cases, ⅜ inch or 1 inch. In some installations, holes may be formed through the sill portion 12 of the flashing 10, e.g., if a nail or screw is inserted through one of the support portions 26. In order to prevent leakage of water through the channel 24 defined by that support portion 26, caulk or other sealant materials can be inserted into the channel 24 before or after the nail or screw is inserted to seal the hole. One or more of the channels 24 can be partially or entirely filled by the caulk or other sealant material.

The rear dam 42 can be configured and/or structured to prevent cutting thereof, such as during installation of drywall near the flashing 10 or otherwise during a building process associated with the wall 112 defining the opening 110. For example, as shown in FIG. 4, the rear dam 42 can define an offset portion 86 proximate each of the jamb portions 16, 18, the offset portion 86 being offset in a direction toward the front face plate 22 relative to the adjacent portion of the rear dam 42. In addition or alternative, the rear dam 42 can define a structural reinforcement member 88 proximate each of the jamb portions 16, 18. The structural reinforcement member 88 can be an integral part of the flashing 10, such as a portion of the rear dam 42 that is relatively thicker than the adjacent portions of the rear dam 42 to resist cutting thereof. Alternatively, the reinforcement member 88 can be separately formed member that is provided on the rear dam 42 to structurally reinforce the rear dam 42 proximate the location of the jamb portions 16, 18. The reinforcement member 88 can be formed of a material that is relatively stronger than the material of the rear dam 42. In particular, the rear dam 42 can be a molded polymer, and the reinforcement member 88 can be a metal clip or other protector that is attached to the top edge 44 of the rear dam 42 to prevent cutting of the rear dam 42. Such a reinforcement member 88 can provide sufficient resistance to cutting that the rear dam 42 is not damaged even if a router or other cutting instrument is brought into contact therewith, e.g., while cutting drywall on the inside surface of the wall 112 along the periphery of the opening 110 to remove the drywall from the proximity of the opening 110 in the wall 112.

FIG. 9 illustrates a window assembly in which the flashing 10 is partially installed in the opening 110 of the wall 112, the placement of the window 114 is indicated. The wall 112 typically includes outer and inner wall members supported by framing members, the outer and inner wall members defining the outer and inner surfaces 116, 117 respectively, of the wall 112, and the framing members disposed therebetween. For example, the inner wall member can be formed of sheets of drywall or plasterboard, and the outer wall member (or exterior sheathing) can be formed of sheets of plywood, both of which are nailed to and supported by an internal structure of the framing members, such as wooden beams or metal studs. A laminar sheet of barrier material can be provided on the outer surface 116 of the wall 112 and the sill 118. The flashing 10 is installed at the bottom of the opening 110. In particular, the installer cuts the sill portion 12 of the unitary flashing 10 of FIG. 1 into the first and second parts 52, 54 and trims the discardable portion 56 from the second part 54 according to the size of the opening 110. The installer disposes the second part 54 of the flashing 10 at one corner of the opening 110 and the first part 52 (shown in dashed lines in FIG. 9 for clarity) at the opposite corner of the opening 110, with the jamb portion 16 of the first part 52 disposed against one of the jambs 120 of the opening 110, the jamb portion 18 of the second part 54 disposed against the opposite jamb 120 of the opening 110, the front face plate 22 of both parts 52, 54 disposed against the outer surface 116 of the wall 112, the sill portion 12 of both parts 52, 54 disposed against the sill 118 of the opening 110, and the integral housing 50*a* of the first part 52 overlapping at least one of the support portions 26 of the second part 54. As indicated in FIG. 9, the window 114 is disposed in the opening 110 such that the window 114 is supported by the flashing 10.

In some cases, the drywall sheets at the inner surface 117 of the wall 112 are disposed after the flashing 10 (and, possibly, the window 114) is disposed. In a conventional manner described above, the drywall provided as the inner wall member at the inner surface 117 of the wall 112 may be initially placed on the wall 112 to at least partially cover the opening 110, and then a portion of the drywall at the opening 110 can be removed by cutting the drywall along the periphery of the window 114 with a router or other cutting tool. For example, FIG. 10 illustrates the inside of the wall 112 at the opening 110 after one or more pieces 111 of drywall has been hung on the inner surface 117 of the wall 112 to partially cover the bottom of the opening 110. Using the periphery of the opening 110 (or, a space between the periphery of the opening and the outer periphery of the window 114) as a guide for the rotating bit of an electric router 122, an installer translates the router 122 around the bottom periphery of the opening to cut a piece of the drywall from the opening to thereby expose the bottom portion of the opening 110. As the router 122 is moved downward along the jamb and against the flashing at the corner of the jamb and sill, the bit of the router 122 contacts the reinforcement member 88, which is sufficiently strong to prevent the router 122 from cutting through the rear dam 42. Thereafter, another piece of drywall can be disposed on the wall 112 to cover the top portion of the opening 110, and the installer can move the router 122 about the top peripheral portion of the opening 110 to cut the drywall from the top of the opening 110. In some cases, the drywall can be initially installed on the wall 112 to completely cover the opening 110, and the installer can remove the drywall from the opening 110 in one cutting operation. For example, in some cases (such as in the case of a vinyl clad window having a frame that is thinner than the thickness of the wall 112, as discussed further below), the drywall may be disposed over the entire opening 110, and the installer can then plunge the rotating bit into the drywall at a position within the opening 110 and move the router 122 outward toward the periphery of the opening 110 until the bit contacts the periphery of the opening 110, which is then used as a guide around the opening 110.

In this typical installation, the sill portion 12 of the flashing 10 is disposed horizontally against the sill 118 of the opening 110, each jamb portion 16, 18 is disposed vertically against a respective one of the jambs 120 of the opening 110, and the front face plate 22 is disposed vertically against the outer surface 116 of the wall 112. One of the housings 50 overlaps the interface 58 between the adjacent parts 52, 54 of the flashing 10 so that water disposed on the housing 50 is prevented from passing through the interface 58 to the sill 118 of the opening 110. Instead, water on the housing 50 is directed to the adjacent channels 24, which direct the water toward and through the front face plate 22. In this way, the flashing 10 can provide continuous protection across the entire length of the sill 118 of the opening 110, including at the corners where the sill 118 meets the jambs 120 of the opening 110. Siding or other materials can then be disposed in a conventional manner on the outer surface 116 of the wall 112, typically after the flashing 10 and the window 114 are installed. The siding can be vinyl or aluminum siding strips, wood shingles, stucco, bricks, and the like, and typically covers the front face plate 22 and the wall 112 around the opening 110.

Figure 10A:
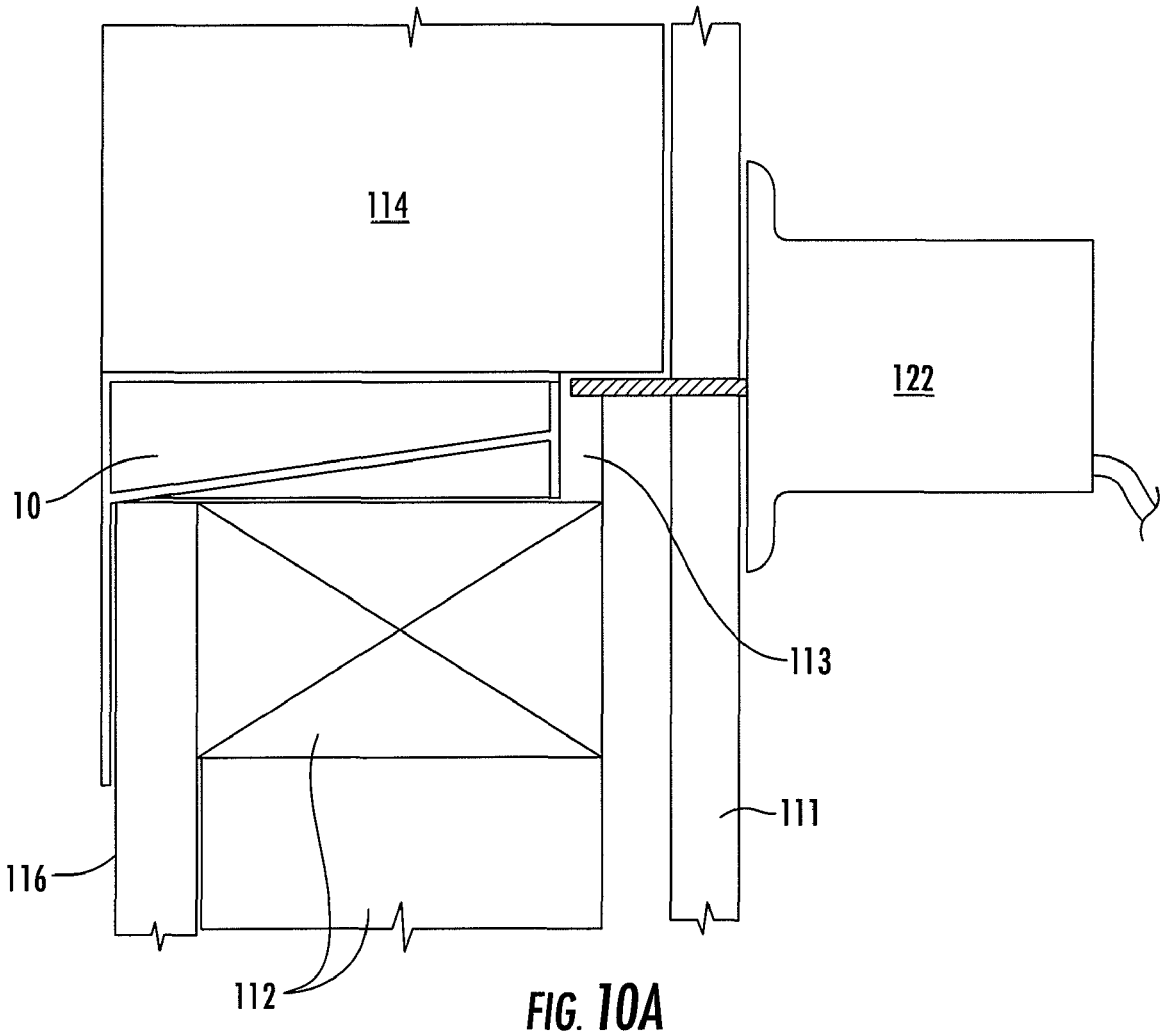
FIG. 10A is a section view in elevation illustrating the flashing of another embodiment installed in the wall with a window or other portal during removal of a piece of drywall from the inner surface of the wall at the location of the opening.

As illustrated in FIG. 10A, the flashing 10 can be sized and positioned so that the rear surface of the flashing 10 is not coplanar with the inner surface of the wall 112 and/or the frame of the window 114 but is instead offset in a direction toward outer surface 116 and the front face plate 22. In the illustrated embodiment, the rear dam 42 is configured to be disposed about ¼ or ½ inch closer to the front surface 116 than the back of the window 114. During installation of the drywall 111 at the inner surface of the wall 112, a gap or space 113 is defined behind the flashing 10 along part or the entire length of the sill portion 12 of the flashing 10 so that the rotating bit of the router 122 does not contact the flashing 10. The flashing 10 is typically configured to extend sufficiently back to underlie all portions of the window 114 where water might leak.

Windows having any of various configurations can be installed in the wall 112 opening 110 according to the present invention. For example, as shown in FIG. 9, the window 114 includes a frame having a bottom frame member, or sill member. Window frames, which are further described in U.S. Patent Application Publication No. 2005/0166471, can support a sash having one or more glass panes as well and/or a screen. Also, an inner frame can be provided on the inner wall member to cover an interface between the inner wall member and the window 114, thereby restricting air from passing between the two members and improving the aesthetic appeal of the window assembly. A windbreak can also be disposed between the wall 112 and the window frame, e.g., proximate to the outer wall member, to restrict the passage of air between the wall opening 110 and the window frame.

The frame, which can be formed of wood, wood composites, polymer coated wood, and the like, can be at least partially supported by the support portions 26 and/or the rear dam 42 of the flashing 10. The sill member can be disposed at an angle relative to the upper ends 32 of the support portions 26, but is typically disposed directly on the support portions 26 unless shims are to be provided therebetween to adjust the position of the window 114 in the opening 110 of the wall 112.

In some embodiments of the present invention, the flashing 10 is configured to be used in an opening 110 of a wall 112 that is thicker than the portal disposed therein. For example, contemporary vinyl clad windows used in the residential building industry typically include a vinyl frame that is thinner than the thickness of the wall 112 in which the frame is disposed. That is, the distance between the inner surface 117 of the wall 112 and the outer surface 116 of the wall 112 is greater than the thickness of the frame of the window 114, as measured in the same direction between the outer and inner surfaces 116, 117 of the wall 112. If the flashing 10 is sized to correspond to the thickness of the wall 112, the flashing 10 may also be wider than the window 114. The flashing 10 in this case can be configured so that the channels 24 extend from the face plate 22 and terminate under the window frame, i.e., the channels 24 do not extend further inward than the inner surface of the window frame that is directed toward the inside of the building defined by the wall 112.

Figure 21:
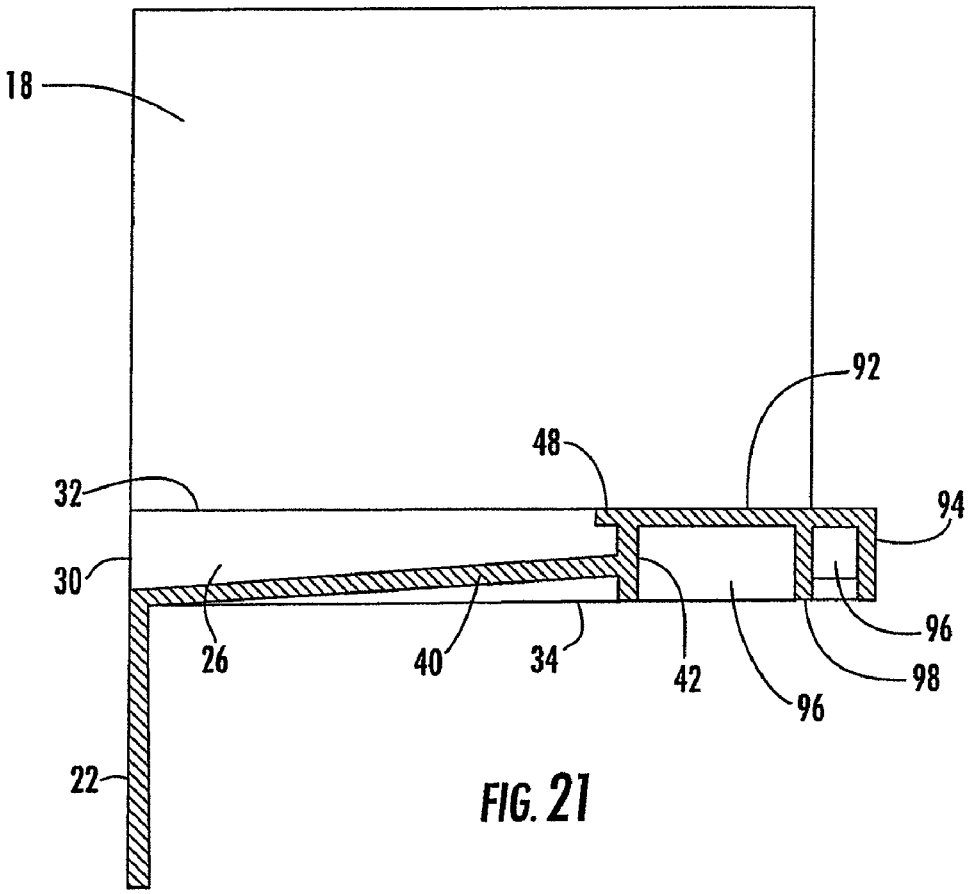
FIG. 21 is a section view similar to FIG. 19 illustrating the sill flashing of another embodiment including a return flange extending from the rear dam.

In this regard, FIGS. 12-21 illustrate a sill flashing 10 according to one embodiment of the present invention in which the sill portion 12 defines a shelf 90 that extends longitudinally along the sill portion 12 and extends from the rear dam 42 in a direction opposite the front face plate 22, i.e., in a direction toward the inside of the building. As illustrated in FIGS. 12-16 and 20, the sill portion 12, jamb portions 16, 18, and front face plate 22 of the flashing 10 are similar to the embodiment of FIG. 1; however, the shelf 90 and the channels 24 can be configured so that the total width of the sill portion 12 measured in the transverse direction is about equal to the thickness of the wall 112. As shown in FIG. 21, a return flange 48 can be provided on the rear dam 42.

Figure 17:
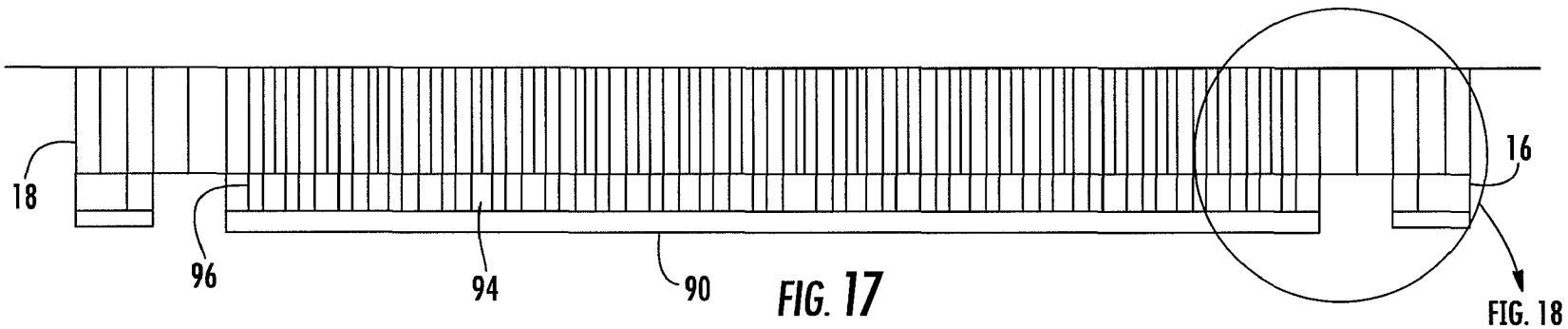
FIG. 17 is a bottom view illustrating the sill flashing of FIG. 12.
Figure 18:
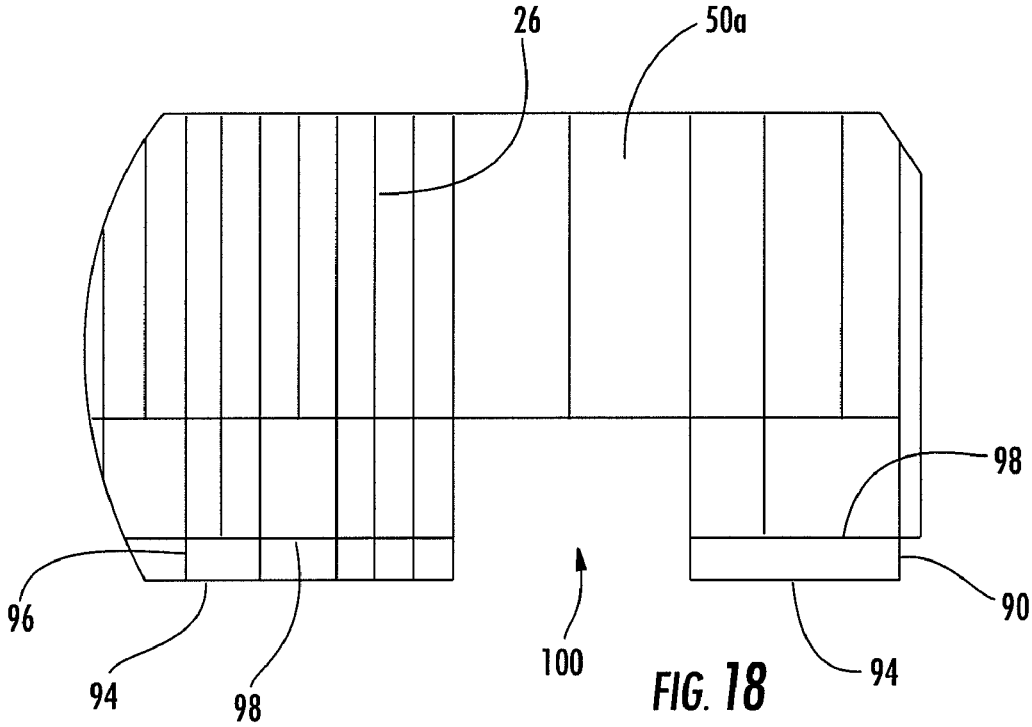
FIG. 18 is bottom view partially illustrating the sill portion of the sill flashing as indicated in FIG. 17.
Figure 19:
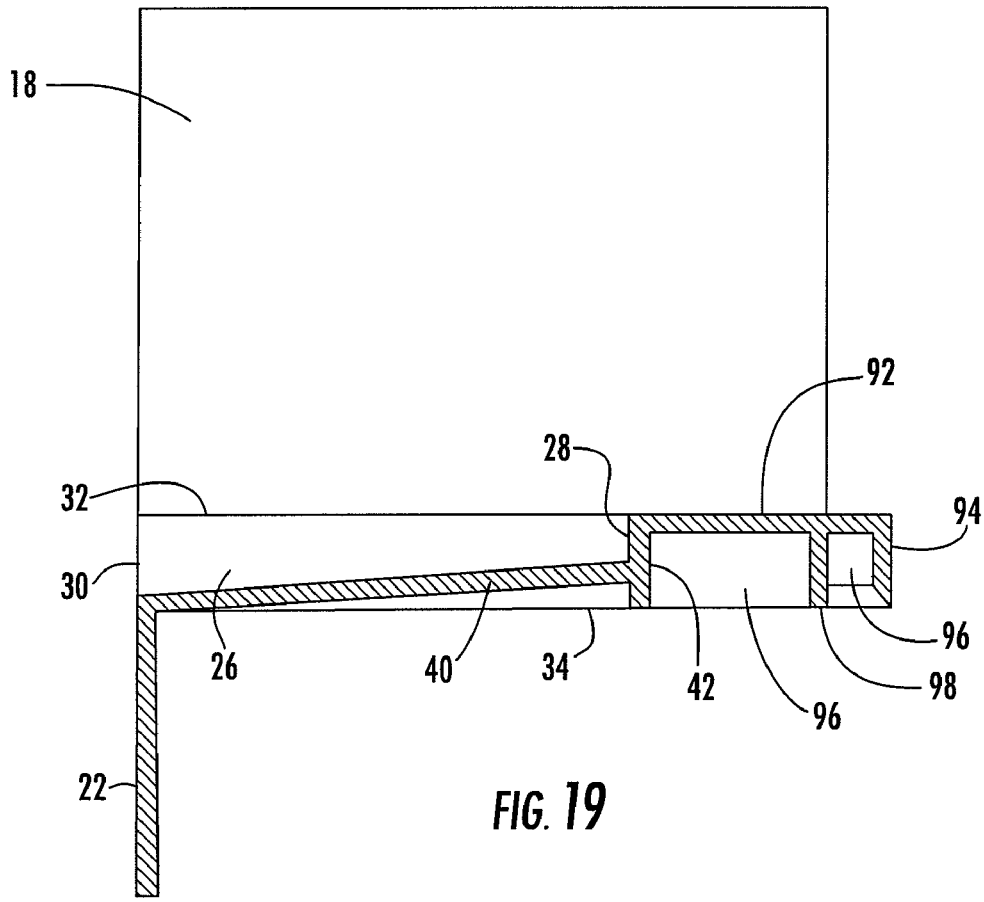
FIG. 19 is a section view illustrating the sill flashing of FIG. 12 as seen along line 19-19 of FIG. 15.
Figure 20:
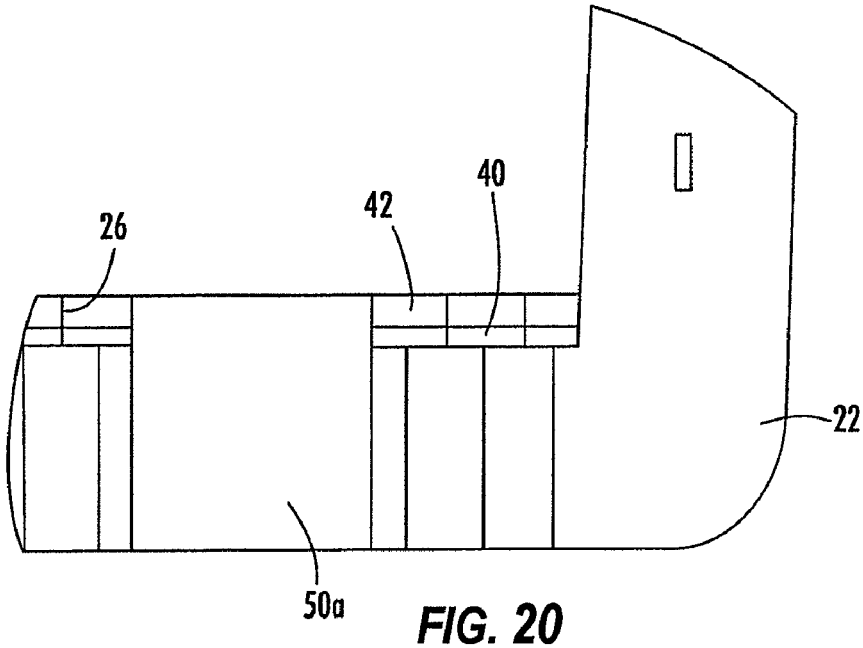
FIG. 20 is an elevation view partially illustrating the sill flashing as indicated in FIG. 15.

As shown in FIGS. 17-19, the shelf 90 can have a substantially hollow construction that is defined by a top surface 92 that extends rearwardly from the rear dam 42 and a rear surface 94 that extends downward from the top surface 92. A plurality of flanges or ribs 96 can be provided between the rear dam 42, the top surface 92, and the rear surface 94 within the space defined by the three surfaces 42, 92, 94. In some cases, a longitudinal flange or rib 98 can also extend longitudinally within the space. During installation, the shelf 90 can be trimmed or removed entirely from the flashing 10, e.g., to correspond to the desired dimensions for a particular installation. In this regard, grooves or other trim features can be provided along a longitudinal direction of the sill portion 12 to facilitate the removal of a portion or entirety of the shelf 90. The flashing 10 can be used with windows or other portals having various dimensions, including windows that vary in thickness or depth between their inner and outer surfaces. Accordingly, an installer (as well as retailer, distributor, and manufacturer) can stock fewer flashings 10 than would otherwise be required if a different flashing were required for every window of different sizes.

When the window 114 is disposed in the opening 110, the window frame typically covers at least a portion of the shelf 90; however, the shelf 90 can extend rearwardly beyond the window frame such that the rearmost portion of the shelf 90 is exposed. The top surface 92 of the shelf 90 can remain exposed after the installation is complete, or an additional cover material can be provided, such as a millwork trim or drywall, over the top surface 92. It will be appreciated that fasteners can be disposed through the shelf 90, e.g., when installing a wooden trim of the window, without compromising the sealing integrity of the flashing 10. That is, even if a nail or screw is disposed vertically through the shelf 90 thereby forming hole in the shelf 90, the resulting hole does not affect the operation of the channels 24 for directing water outward from the opening 110. Further, the shelf 90 is located inward from the channels 24 and at a position typically not associated with leaks of water through the window 114.

Figure 14:
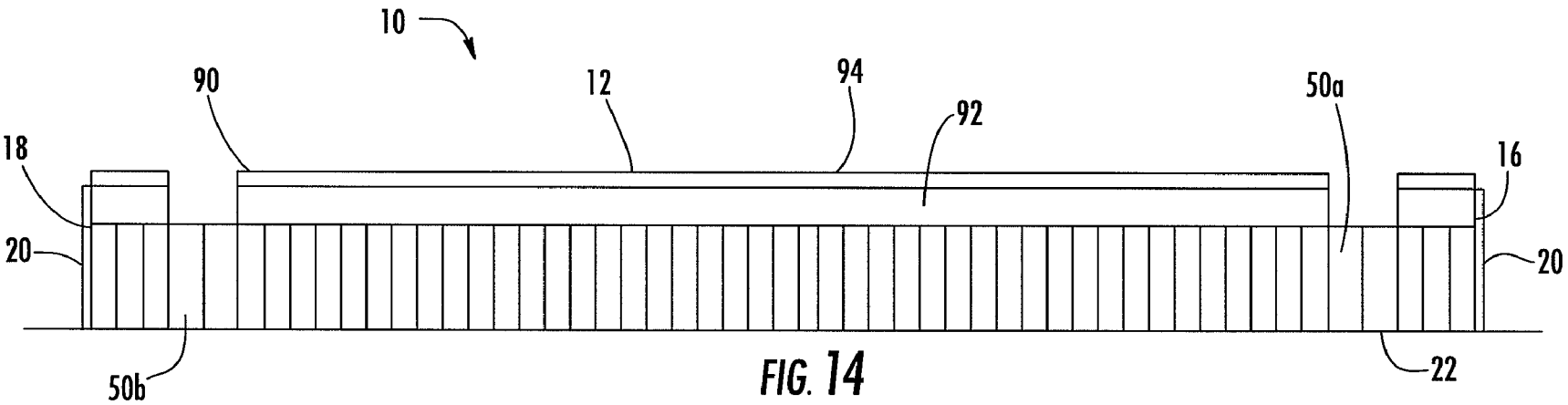
FIG. 14 is a plan view illustrating the sill flashing of FIG. 12.
Figure 15:
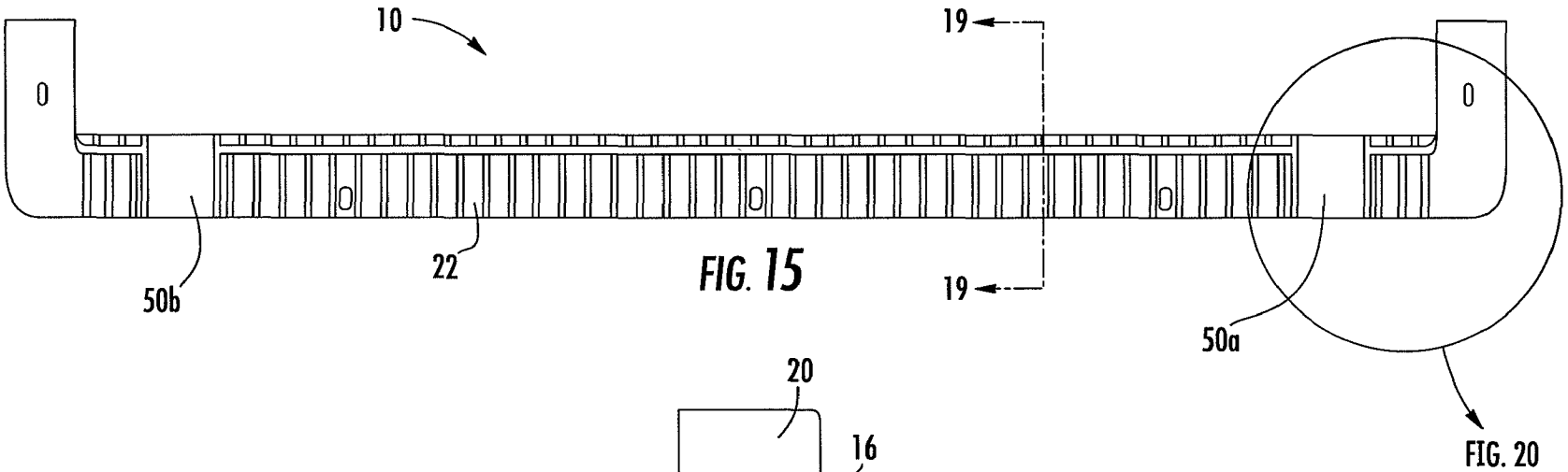
FIG. 15 is an elevation view illustrating the sill flashing of FIG. 12.
Figure 16:
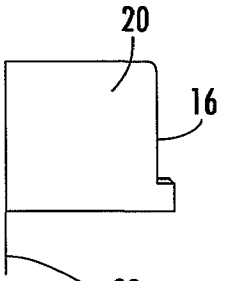
FIG. 16 is a side elevation view illustrating the sill flashing of FIG. 12, as seen from the right side of FIG. 15.

The shelf 90 can also define one or more gaps. In particular, the shelf 90 can define a gap 100 that is proximate each of the housings 50, e.g., a gap located longitudinally between the side walls 62 of each of the housings 50 as shown in FIGS. 14, 17, and 18. The gaps 100 can facilitate the cutting and trimming of the flashing 10. For example, when the flashing 10 is to be cut proximate one of the housings 50, the cut can be made through the sill portion 12 at one of the gaps 100 without requiring the shelf 90 to be cut by the installer.

The flashings 10 of the present invention can be used in connection with the installation of various portals, such as windows, entry doors, doorways, shower stall entryways, and the like. The flashings 10 can be disposed in combination with a laminar sheet of a moisture barrier material, such as materials used on the outer surfaces of the frame of houses and outer structures and plastic sheets used to line shower stalls before tile or other surface materials are disposed. Methods for installing flashings in combination with such moisture barrier materials are further described in U.S. Patent Application Publication No. 2005/0166471, which is herein incorporated in its entirety. It is appreciated that the flashing 10 can be used to direct water toward either surface of the wall, and relative terms such as "inner surface" and "outer surface" are used herein only for illustrative clarity. For example, in an embodiment where the flashing 10 is disposed in a doorway of a shower stall of a residential bathroom, the flashing can be used to direct water into the shower stall, such that the "outer surface" toward which water is directed corresponds to the inside of the shower stall, and the "inner surface" corresponds to the surface of the wall directed toward the bathroom and away from the shower stall.

In some cases, the various flashings 10 of the present invention can be formed of materials that are especially suited for the particular application for which the flashings 10 are to be used. For example, flashings 10 for use with residential windows can be formed of polymers such as polypropylene; however, if the flashing 10 is to be used in an application in which grout and/or tiles are to be disposed directly against the flashing, such as in a shower assembly, the flashing 10 can be formed of a material to which grout or other adhesives can easily be adhered. In particular, the flashings 10 can be formed of a polymer such as nylon, to which various grouts, adhesives, and the like can be adhered. Alternatively, the various flashings 10 of the present invention can be formed of a polymer or other moldable material in which fibers are disposed. For example, wood fibers can be included in the polymer material of the flashings 10 to increase the adherence between the flashings 10 and grout or other adhesives.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A sill flashing for use in a portal installation in an opening defined by a sill and jambs extending therefrom, the flashing comprising:

a sill portion extending in a longitudinal direction and configured to be disposed against the sill of the opening;

a jamb portion disposed at an angle relative to the sill portion such that an outer surface of the jamb portion is configured to be disposed against one of the jambs of the opening when the sill portion is disposed against the sill of the opening; and a front face plate extending from each of the sill portion and the jamb portion in a plane generally perpendicular to the sill portion and the jamb portion, wherein the sill portion comprises:

a plurality of support portions, each support portion extending between a rear end and a front end and between a lower end and an upper end, the lower ends configured to be disposed against the sill of the opening and the upper ends structured to support a portal disposed thereon in the opening;

a rear dam extending in the longitudinal direction and proximate the rear ends of the support portions;

a plurality of base portions, each base portion extending between adjacent support portions and disposed at an angle relative to the lower ends of the support portions such that each base portion and adjacent support portions define a channel structured to direct water toward and through the front face plate; and at least one integral housing configured to overlap an adjacent one of the support portions such that the flashing can be disposed in at least two parts defining an interface therebetween with the housing being configured to prevent water disposed on the flashing from passing through the interface to the sill of the opening, wherein the housing defines a cover portion extending in the longitudinal direction of the sill portion and two side walls extending from the cover portion and generally perpendicular to the longitudinal direction of the sill portion, and wherein the cover portion is angled toward at least one of the two side walls.

2. A sill flashing according to claim 1 wherein each support portion defines a trim feature extending between the rear and front ends and configured to facilitate removal of the upper end of the support portion.

3. A sill flashing according to claim 1 wherein the sill portion defines a longitudinal shelf extending from the rear dam in a direction opposite the front face plate.

4. A sill flashing according to claim 3 wherein the shelf defines a gap proximate the housing.

5. A sill flashing according to claim 1 wherein the sill portion defines a dam height of at least ⅜ inch when the lower ends of the support portions are disposed horizontally on the sill of the opening, the dam height being measured in a vertical direction from a top of the rear dam to an intersection of the base portions and the front face plate.

6. A sill flashing according to claim 1 wherein the front face plate defines a plurality of trim features to facilitate removal of a longitudinal portion of the flashing.

7. A sill flashing according to claim 1 wherein the rear dam defines an offset portion proximate the jamb portion that is offset in a direction toward the front face plate relative to an adjacent portion of the rear dam.

8. A sill flashing according to claim 1 wherein the rear dam defines a reinforcement member proximate the jamb portion.

9. A sill flashing according to claim 1 wherein the sill portion defines two integral housings.

10. A sill flashing according to claim 9 wherein the integral housings define different lengths in the longitudinal direction of the sill portion with respect to one another.

11. A sill flashing according to claim 9 wherein the sill portion defines score lines on opposite sides of each housing.

12. A sill flashing according to claim 1 wherein the rear dam is configured to define a top edge that is substantially coplanar with the upper end of the support portions such that the support portions and the rear dam are configured to cooperatively provide support for said portal disposed in the opening.

13. A sill flashing according to claim 1 wherein the jamb portion is a first jamb portion at a first longitudinal end of the sill portion, the flashing further comprising a second jamb portion at a second, opposite longitudinal end of the sill portion, each of the jamb portions disposed at substantially right angles relative to the sill portion such that the outer surface of each jamb portion is configured to be disposed against a respective one of the jambs of the opening when the sill portion is disposed against the sill of the opening.

14. A sill flashing according to claim 13 wherein the first and second jamb portions, the sill portion, and the front face plate are formed as integral members formed of a polymer.

15. A sill flashing according to claim 1 wherein the rear dam defines a slot between the two side walls such that the housing can be disposed over at least one of the support portions.

16. A sill flashing according to claim 15 wherein the rear dam and the front face plate define offset portions between the two side walls, the offset portion of the rear dam being offset in a transverse direction relative to adjacent portions of the rear dam, and the offset portion of the front face plate being offset in a transverse direction relative to adjacent portions of the front face plate, the transverse direction being perpendicular to the longitudinal direction of the sill portion.

17. A sill flashing according to claim 1 wherein each support portion is substantially a planar vertical portion.

18. A sill flashing according to claim 1 wherein the rear dam is disposed at an angle relative to the lower ends of the support portions such that the rear dam is angled toward the front face plate.

19. A sill flashing according to claim 1, further comprising a return flange extending from the rear dam in a direction toward the front face plate, the return flange and the support portions defining a space therebetween.

* * * * *